US005718138A

United States Patent [19]

Imanari

[11] Patent Number: 5,718,138

[45] Date of Patent: Feb. 17, 1998

[54] LOOPER CONTROL SYSTEM FOR A ROLLING MILL

[75] Inventor: Hiroyuki Imanari, Chiba, Japan

[73] Assignee: Kabushiki Kaisha Toshiba, Kanagawa-ken, Japan

[21] Appl. No.: 562,477

[22] Filed: Nov. 24, 1995

[30] Foreign Application Priority Data

Nov. 25, 1994 [JP] Japan ..... 6-291727

[51] Int. Cl.[6] ..... B21B 37/00

[52] U.S. Cl. ..... 72/8.6; 72/12.3; 72/205; 364/472.08

[58] Field of Search ..... 72/8.6, 11.4, 12.3, 72/205, 234, 365.2; 364/472.07, 472.08

[56] References Cited

U.S. PATENT DOCUMENTS

| | | | |
|---|---|---|---|
| 4,507,946 | 4/1985 | Koyama et al. | 72/8.6 |
| 5,040,395 | 8/1991 | Seki et al. | 72/8.6 |

FOREIGN PATENT DOCUMENTS

| | | |
|---|---|---|
| 57180383 | 11/1982 | Japan . |
| 05337529 A | 12/1993 | Japan . |
| 06099030 | 4/1994 | Japan . |
| 06297016 A | 10/1994 | Japan . |

OTHER PUBLICATIONS

Publication entitled "Generalization of ILQ Optimum Servo System Design Method," Takao Fujii and Taku Shimomura, Proceedings of System Control Information Society, vol. 1, No. 6, 1988, pp. 194–202 (includes English abstract).

"The Robust Control Problem," Robust Control Toolbox User's Guide, pp. 1–12 – 1–55.

*Primary Examiner*—Lowell A. Larson
*Assistant Examiner*—Ed Tolan
*Attorney, Agent, or Firm*—Finnegan, Henderson, Farabow, Garrett & Dunner, L.L.P.

[57] ABSTRACT

A looper control system has a looper that is interposed between two rolling stands of a tandem rolling mill and is actuated by a hydraulic actuator; and a control calculating section for calculating a speed change rate command value of a primary rolling machine and a pressure command value of a hydraulic looper actuator so that an interstand tension and a looper height can be both controlled at target tension and looper height values, respectively, on the basis of a detected looper height value and a previously determined control gain. A resonance frequency changing section detects hydraulic flow rate of the hydraulic actuator and multiplies it by a gain to obtain a first speed change rate command value; and a damping constant changing section detects pressure in the hydraulic actuator and multiplies it by another gain to obtain a second speed change rate command value. The first and second speed change rate command values are added to a speed command value, and the total is set to the primary rolling machine speed controller.

13 Claims, 13 Drawing Sheets

LOOPER CONTROL SYSTEM FOR A ROLLING MILL

BACKGROUND OF THE INVENTION

1. Field of the Invention

The present invention relates to a looper control system for a rolling mill, and more specifically to a looper control system interposed between two rolling stands of a tandem steel rolling mill, to control a looper height driven by a hydraulic actuator and a tension between the two rolling stands.

2. Description of the Prior Art

A strip thickness and a strip width have been used as evaluation criteria of steel sheet products manufactured by hot rolling or cold rolling. In the case of strip thickness, an automatic strip thickness control system has been used in conventional systems, and in the case of strip width, an automatic strip width control system has been used in conventional systems. On the other hand, a tension applied to the material being rolled (called below "rolling material" or "rolled material") affects the strip thickness or the strip width of the rolled material, so it is also known to control a tension at a target value.

In hot rolling, since the rolled material is heated to a high temperature, a deformation resistance of the rolling material is small, so that when a large tension is applied, the rolling material tends to break. Setting the tension to a small value in order to prevent the rolling material from being broken can result in no tension being applied to the rolling material due to a disturbance or an erroneous tension setting. In this case, since the no tension state continues for a long time, a loop of a large radius may be produced, creating a possibility of an accident. To overcome this problem, a looper control system is provided for the hot rolling mill, in particular to control the tension of the rolling material. In addition, the height of the looper also is controlled to improve the movability of the rolling material.

In the above-mentioned rolling tension and looper height control system, there exists a mutual interference between the rolling material tension and the looper height. In the case where the looper drive unit is a hydraulic type, there is a known PID (proportional plus integral plus derivative) control method for controlling both the rolling material tension and the looper height simultaneously, without suppressing the above-mentioned mutual interference. This conventional method has been adopted for use in rolling mills.

In the conventional PID control method, the tension control has been executed by calculating a pressure required to maintain a target tension value and by setting the calculated pressure as a pressure set value of the looper hydraulic unit. In this case, however, since the tension is not fed back, it has been difficult to always control the tension at a target value.

Further, in the conventional looper height control method, since the mutual interference between rolling material tension and the looper height cannot be suppressed, a resonance frequency point of the control system lies in a relatively low frequency band, so that it has been necessary to suppress the looper height control response speed down to about ⅓ of the resonance frequency of the control system, with the result that it has been difficult to improve the response speed of the control system.

SUMMARY OF THE INVENTION

Accordingly, it is an object of the present invention to provide a looper control system for a rolling mill, which can control the height of the looper interposed between two tandem rolling mill stands and the tension of rolling material between the stands, in such a way as to enable an optimum control of the looper height and the interstand tension of the rolling material at a high response speed, without mutual interference between the looper height and the interstand tension of the rolling material.

To achieve the above-mentioned object, a first embodiment of the present invention provides a looper control system having a looper interposed between two rolling stands of a tandem rolling mill and actuated by a hydraulic actuator; and control calculating means for calculating a speed change rate command value of a primary rolling machine and a pressure command value of a hydraulic looper actuator so that an interstand tension of rolling material and a looper height both can be controlled at a target tension value and a target looper height, respectively, on the basis of a detected looper height value and a previously determined control gain; the calculated pressure command value being set to the looper hydraulic actuator, the calculated speed change rate command value of the primary rolling machine being added to a speed command value, and the added speed command value being set to a primary machine controller, which comprises: resonance frequency changing means for detecting hydraulic flow rate or a value equivalent thereto of the hydraulic actuator and multiplying the detected value by a gain, to obtain a first speed change rate command value of the primary rolling machine; and damping constant changing means for detecting pressure or a value equivalent thereto in the hydraulic actuator and multiplying the detected value by another gain, to obtain a second speed change rate command value of the primary rolling machine; and wherein the first and second speed change rate command values are added to a speed command value of the primary rolling machine, and the added speed command value is set to the primary rolling machine speed controller.

Further, a second embodiment of the present invention provides a looper control system having a looper interposed between two rolling stands of a tandem rolling mill and actuated by a hydraulic actuator; and control calculating means for calculating a speed change rate command value of a primary rolling machine and a pressure command value of a hydraulic looper actuator so that an interstand tension of rolling material and a looper height both can be controlled at a target tension value and a target looper height, respectively, on the basis of a detected looper height value and a previously determined control gain; the calculated pressure command value being set to the looper hydraulic actuator, the calculated speed change rate command value of the primary rolling machine being added to a speed command value, and the added speed command value being set to a primary machine speed controller, wherein said control calculating means comprises: a first cross-controller for canceling an interference transfer function from a speed command value of the primary rolling machine to a looper angle and a second controller for canceling another interference transfer function from a pressure command value of the looper hydraulic actuator to the interstand tension of the rolling material, both by modeling a multi-variable system having a mutual interference between the looper height and the interstand tension of the rolling material as a transfer function, and a tension controller for controlling a detected tension value at a target tension value and an angle controller for controlling a detected looper angle value at a target looper angle value, both on condition that the mutual interference can be eliminated by said first and second controllers; and wherein an output of said tension controller is inputted to said first controller; an output of said first controller is added to an output of said angle controller as a pressure command value of the looper hydraulic actuator; an output of said angle controller is inputted to said second controller; and an output of said second controller is added to an output of said tension controller as a speed change rate command value of the primary rolling machine.

Further, a third embodiment of the present invention provides a looper control system having a looper interposed between two rolling stands of a tandem rolling mill and actuated by a hydraulic actuator; and control calculating means for calculating a speed change rate command value of a primary rolling machine and a pressure command value of a hydraulic looper actuator so that an interstand tension of rolling material and a looper height both can be controlled at a target tension value and a target looper height, respectively on the basis of a detected looper height value and a previously determined control gain; the calculated pressure command value being set to the looper hydraulic actuator, the calculated speed change rate command value of the primary rolling machine being added to a speed command value, and the added speed command value being set to a primary machine speed controller, which comprises: a controlled process model obtained by modeling a multi-variable system having mutual interference between the looper height and the interstand tension of the rolling material, for outputting an interstand tension under due consideration of a looper height and a weight parameter, as an output of a looper height control system, so that the interstand tension of the rolling material can be controlled not only by the speed change rate command value given to the primary rolling machine but also by a pressure command value given to the looper hydraulic actuator; multi-variable control setting means for setting variables representative of the controlled process model, variables for designating response speeds of the interstand tension of the rolling material and the looper height, variables for adjusting the response speeds of the interstand tension of the rolling material and the looper height, and weight parameters, respectively; and multi-variable control gain calculating means for substituting the set values obtained by said multi-variable control setting means for predetermined control gain equations, to obtain control gains used by the control calculating means as numerical values.

Further, a fourth embodiment of the present invention provides a looper control system having a looper interposed between two rolling stands of a tandem rolling mill and actuated by a hydraulic actuator; and control calculating means for calculating a speed change rate command value of a primary rolling machine and a pressure command value of a hydraulic looper actuator so that an interstand tension of rolling material and a looper height both can be controlled at a target tension value and a target looper height, respectively on the basis of a detected looper height value and a previously determined control gain; the calculated pressure command value being set to the looper hydraulic actuator, the calculated speed change rate command value of the primary rolling machine being added to a speed command value, and the added speed command value being set to a primary machine speed controller, which comprises: a controlled process model obtained by modeling a multi-variable system having mutual interference between the looper height and the interstand tension of the rolling material, for outputting an interstand tension under due consideration of a looper height and a weight parameter as an output of a looper height control system, so that the interstand tension of the rolling material can be controlled not only by the speed change rate command value given to the primary rolling machine but also by a pressure command value given to the looper hydraulic actuator; robust control setting means for setting variable values for constituting the controlled process, the weight parameters, weight functions for designating response speed and robust stability of a tension control system, weight functions for designating response speed and robust stability of the looper height control system, respectively, on the basis of rolling conditions and rolled state; and robust control gain calculating means calculating the values set by said robust control setting means in accordance with predetermined control gain calculating equations, to obtain control gains used by said control calculating means.

Further, a fifth embodiment of the present invention provides a looper control system, comprising: a looper interposed between two rolling stands of a tandem rolling mill and actuated by a hydraulic actuator; looper height setting means for calculating a position command value of a hydraulic position controller so that a looper height can be controlled at a target looper height value and for setting the calculated position command value to the hydraulic position controller; and tension control means for calculating a speed change rate command value of a primary rolling machine so that the interstand tension of the rolling material can be controlled at a target tension value; the calculated speed change rate command value of the primary rolling machine being added to a speed command value, and the added speed command value being set to a speed controller of the primary rolling machine.

Further, in the second to fifth embodiments of the present invention, the interstand tension is detected by any one of means for calculating an interstand tension on the basis of a tension meter mounted on a the looper; and means for detecting hydraulic flow rate or a value equivalent thereto in a hydraulic actuator and further for calculating a pressure value due to a tension of the rolling material, in such a way that a looper weight, an interstand weight of the rolling material, a drive loss, and a pressure caused by looper acceleration or deceleration at looper angle or hydraulic actuator position are all subtracted from a detected inner pressure value of the hydraulic pressure, to obtain an interstand tension value of the rolling material on the basis of the calculated pressure value.

DETAILED DESCRIPTION OF THE PREFERRED EMBODIMENTS

The principles and function of the present invention will be described hereinbelow with reference to the attached drawings.

Figure 1:
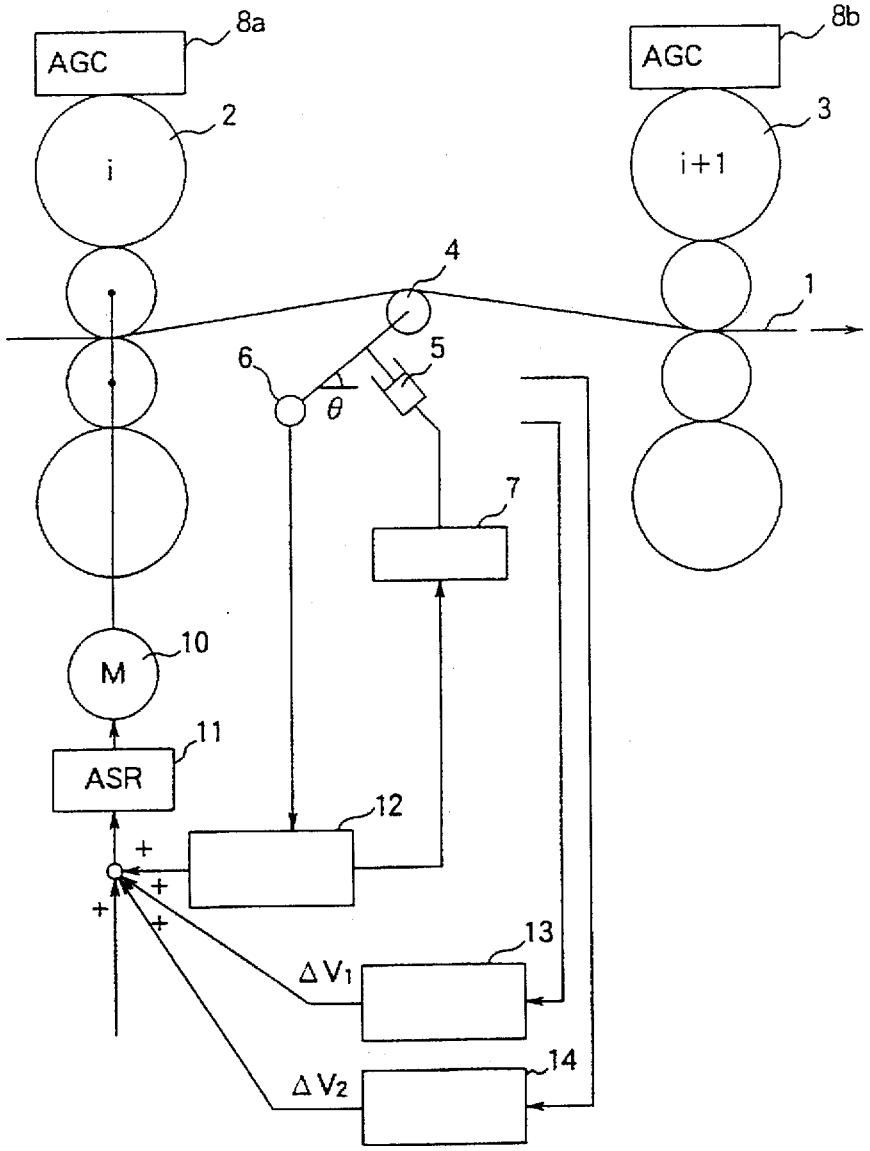
FIG. 1 is a schematic block diagram broadly depicting a first embodiment of a looper control system according to the present invention.

FIG. 1 is a schematic block diagram showing a first embodiment of the looper control system according to the present invention. In the drawing, a rolling material 1 (e.g., steel) is rolled by an i-th stand rolling mill 2, an (i+1)th stand rolling mill 3, and so on in sequence. The total number (n) of the stands of the tandem rolling mill is usually from five to seven (n=5 to 7). A looper control system is interposed between two stands, respectively. Here, however, only the looper control system interposed between the two i-th and (i+1)th stands will be described hereinbelow. Substantially identical looper control systems can be applied to other stands, where i lies in a range of $1 \leqq i \leqq n-1$.

In FIG. 1, a looper 4 is interposed between the i-th stand 2 and the (i+1)-th stand 3. The looper 4 is directly actuated by a hydraulic actuator 5 of a cylinder type or a rotating motor type, and the pressure of this hydraulic actuator is controlled by a hydraulic unit 7. Further, the looper height is detected by a looper height detecting unit 6, and then transformed into the looper angle θ.

The speed of a driver motor 10 of the i-th primary rolling machine can be controlled by a primary rolling machine speed controller 11. To this primary rolling machine speed controller 11, a speed command necessary to roll a rolling material at a desired speed is given. Further, a speed change rate command value is set to control the interstand tension of the rolling material. The final speed is determined by adding these commands as a final speed set value.

Each stand also is provided with a plate thickness controller (AGC: automatic gauge control) 8*a* or 8*b*. Therefore, whenever the AGC unit is activated, since an interstand mass flow fluctuates, this causes fluctuations in the rolling material tension.

The first embodiment of the looper control system according to the present invention can be summarized as follows: in the same way as with the case of the conventional PI type looper control system, the control system has control calculating means 12 for calculating a speed change rate command value of the primary rolling machine 10 and a pressure command value of the looper hydraulic actuator 5 so that the interstand tension of the rolling material and a looper height detected by the looper height detecting unit 6 both can be controlled at a target tension value and a target looper height, respectively. In addition, the looper control system further comprises resonance frequency changing means 13 for detecting a hydraulic flow rate or a value equivalent thereto in the hydraulic actuator 5 and for multiplying the detected value by a gain to obtain a first speed change rate command value $\Delta V_1$ of the primary rolling machine and damping constant changing means 14 for detecting a pressure or a value equivalent thereto in the hydraulic actuator 5 and for multiplying the detected value by another gain to obtain a second speed change rate command value $\Delta V_2$ of the primary rolling machine. Further, the two command values $\Delta V_1$ and $\Delta V_2$ are added to a speed command value of the primary rolling machine. Further, the added speed command value of the primary rolling machine is set to the speed controller 11 of the primary rolling machine so that the resonance frequency and the damping constant are both changed to any desired values. That is, when the resonance frequency is changed to a high frequency band and the damping constant is increased, it is possible to set the response of the looper height control system to a high frequency range, so that a high response speed can be obtained.

Further, when the hydraulic pressure supplied to the hydraulic actuator is integrated, the hydraulic flow rate can be obtained. Further, when the flow rate is further integrated, the piston position can be obtained. Therefore, the value equivalent to the hydraulic flow rate corresponds to an integral value of the hydraulic pressure or a differential value of the piston position. The use of these values is advantageous, because it is unnecessary to directly detect the flow rate. Further, the value equivalent to the pressure corresponds to a differential value of the flow rate or a quadratic differential value of the piston position. These values are used when the pressure cannot be detected directly.

Figure 2:
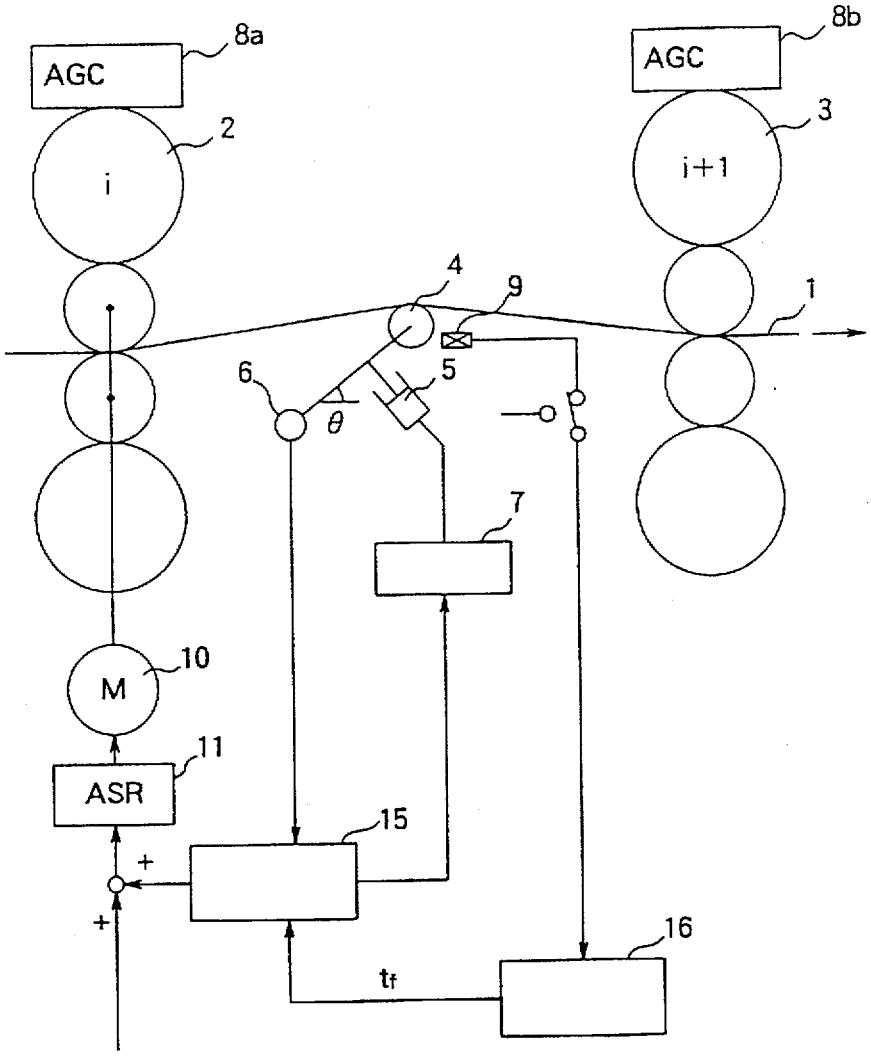
FIG. 2 is a schematic block diagram broadly depicting a second embodiment of a looper control system according to the present invention.

FIG. 2 is a schematic block diagram showing a second embodiment of the looper control system according to the present invention. In the drawing, when the interstand tension of the rolling material is detected, there are two methods of using a tension detecting load cell 9 mounted on the looper (e.g., as disclosed in Japanese Patent Application No. 3-13501) and a method of calculating the tension on the basis of the pressure of the hydraulic cylinder 5. The tension calculating means 16 detects the tension applied to the rolling material by use of any one or both of the signals detected by these two methods.

The second embodiment of the looper control system according to the present invention can be summarized as follows: the looper control system is provided with control calculating means 15 for calculating a speed change rate command value of the primary rolling machine 10 and a pressure command value of the hydraulic looper actuator 7 so that the interstand tension of the rolling material calculated by tension calculating means 16 and the looper height detected by a looper height detecting unit 6 both can be controlled at a target tension value and a target looper height, respectively. This control calculating means 15 comprises a first cross-controller for cancelling an interference transfer function from a speed command value of the primary rolling machine to a looper angle, and a second cross-controller for cancelling another interference transfer function from a pressure command value of the looper hydraulic actuator to the interstand tension of the rolling material, both by modeling a multi-variable system having a mutual interference between the looper height and the interstand tension of the rolling material as a transfer function; and a tension controller for controlling a detected tension value at a target tension value and an angle controller for controlling a detected looper angle value at a target looper angle value, both on condition that the mutual interference can be eliminated by the first and second controllers, respectively. Here, an output of the tension controller is inputted to the first cross-controller, and an output of the first cross-controller is added to an output of an angle controller as the pressure command value of the looper hydraulic actuator. Further, an output of the angle controller is inputted to the second cross-controller, and an output of the second cross-controller is added to an output of the tension controller as a speed change rate command value of the primary rolling machine. As a result, the system having an internal mutual interference can be changed to a system of non-interference, so that it is possible to set a high tension control response speed and a high looper height control response speed, without considering the resonance frequency which suppresses the high looper height control response speed.

Figure 3:
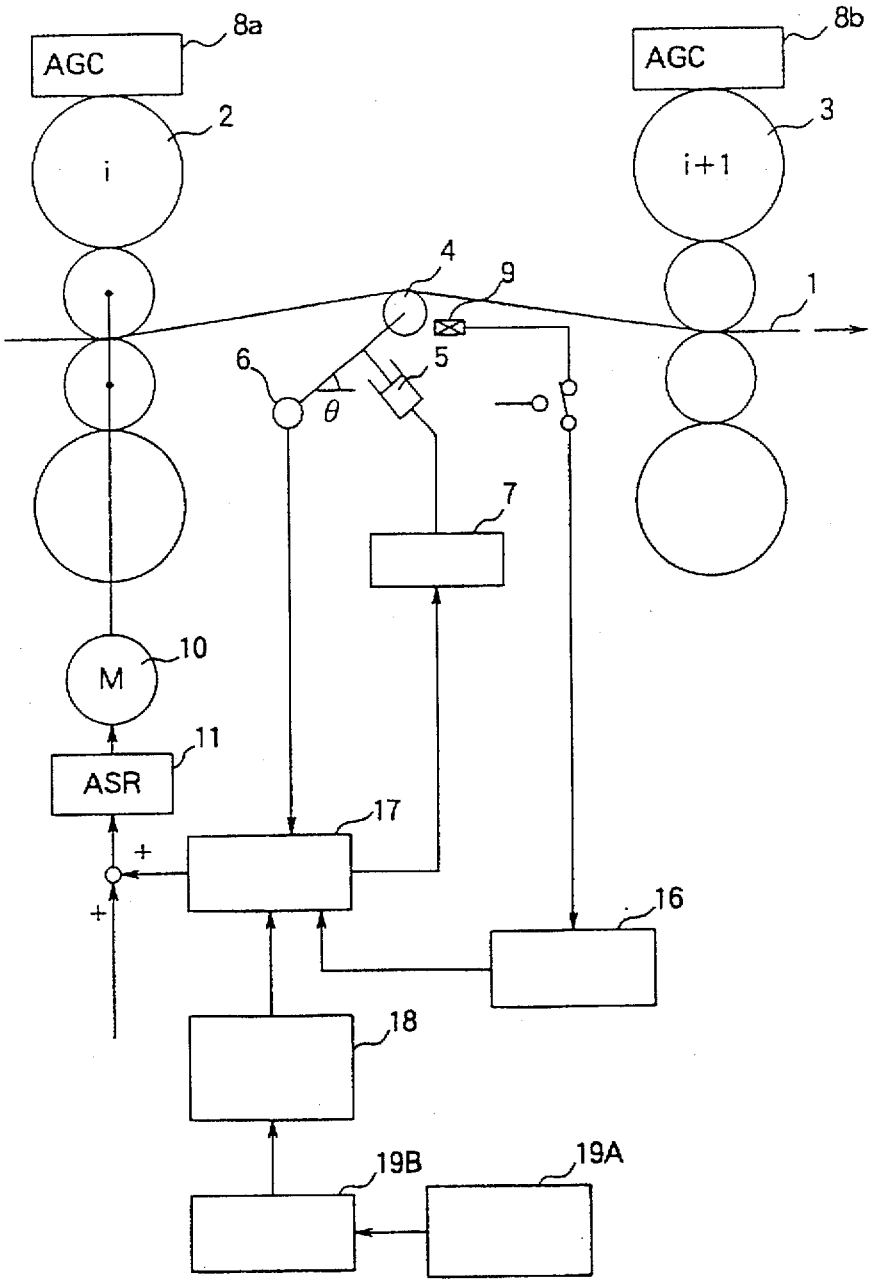
FIG. 3 is a schematic block diagram broadly depicting a third embodiment of a looper control system according to the present invention.

FIG. 3 is a schematic block diagram showing a third embodiment of the looper control system according to the present invention. The third embodiment of the looper control system according to the present invention can be summarized as follows: in the drawing, the looper control system is provided with control calculating means 17 for calculating a speed change rate command value of the primary rolling machine 10 and a pressure command value of the hydraulic looper actuator 7 so that the interstand tension of the rolling material calculated by the tension calculating means 16 and the looper height detected by a looper height detecting unit 6 both can be controlled at a target tension value and a target looper height respectively. A process model of a controlled system 19A for controlling a multi-variable system can be obtained by modeling the multi-variable system having the mutual interference between the looper height and the interstand tension of the rolling material, which is a controlled process model for outputting an interstand tension under due consideration of a looper height and a weight parameter, as an output of a looper height control system, so that the interstand tension of the rolling material can be controlled not only by the speed change rate command value given to the primary rolling machine 10 but also by a pressure command value given to the looper hydraulic actuator 5. Further, multivariable control setting means 19B sets variables representative of the controlled process models, variables for designating response speeds of the interstand tension of the rolling material and the looper height, variables for adjusting the response speeds of the interstand tension of the rolling material and the looper height, and weight parameters, respectively. Multivariable control gain calculating means 18 substitutes the set values obtained by the multi-variable control setting means 19B for predetermined control gain equations, to obtain control gains used by the control calculating means 17 as numerical values. Therefore, the system can cope with the set values varying every moment, at a high response speed, so that it is possible to attain an optimum control performance at all times according to various rolling conditions. Further, since the weight parameters are introduced, the tension fluctuations can be suppressed by the looper height, so that the tension control can be executed in cooperation with the primary rolling machine 10.

Figure 4:
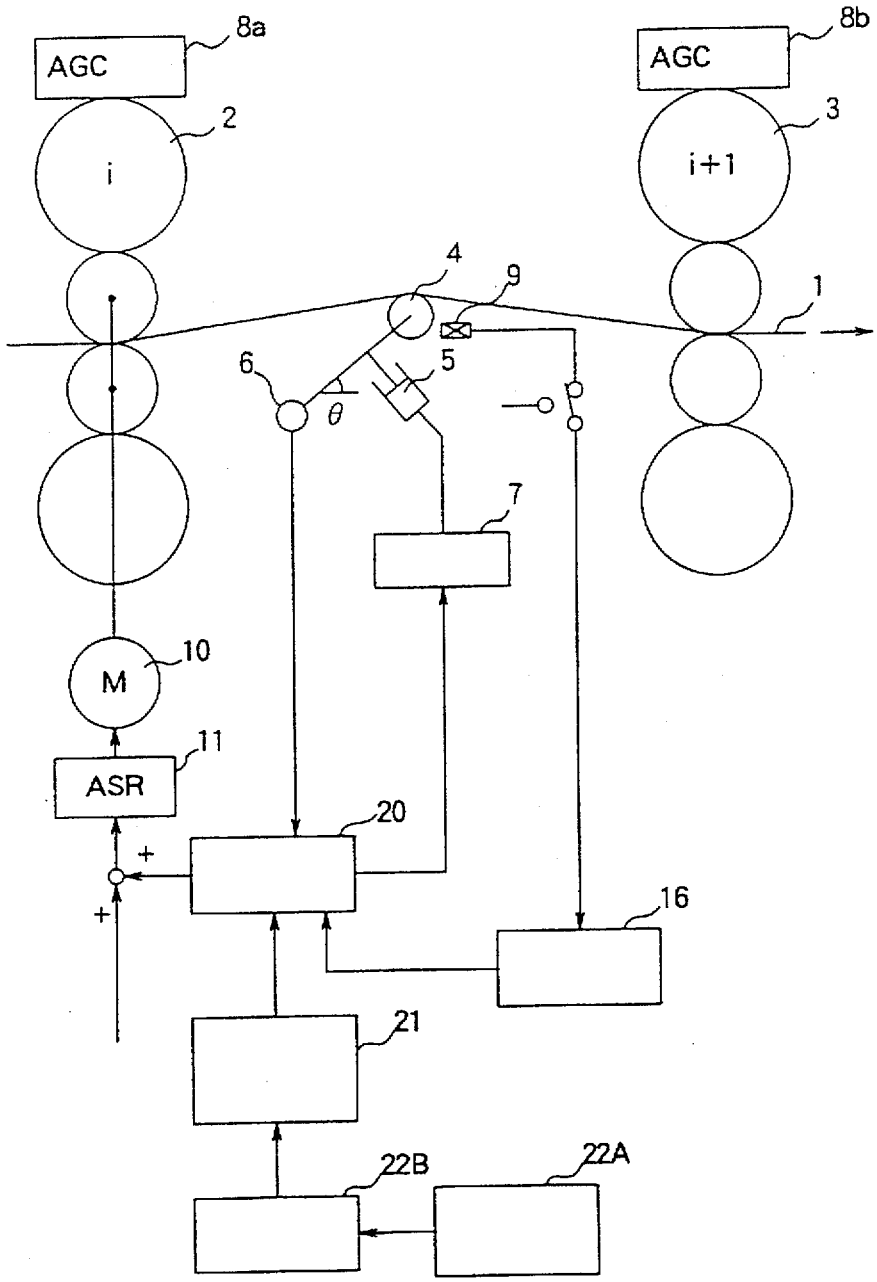
FIG. 4 is a schematic block diagram broadly depicting a fourth embodiment of a looper control system according to the present invention.

FIG. 4 is a schematic block diagram showing a fourth embodiment of the looper control system according to the present invention. The fourth embodiment of the looper control system according to the present invention can be summarized as follows: in the drawing, the looper control system is provided with control calculating means 20 for calculating a speed change rate command value of the primary rolling machine 10 and a pressure command value of the hydraulic looper actuator 7 so that the interstand tension of the rolling material calculated by the tension calculating means 16 and the looper height detected by a looper height detecting unit 6 both can be controlled at a target tension value and a target looper height, respectively. The process model for a controlled system 22A for controlling the system robust can be obtained by modeling the multi-variable system having the mutual interference between the looper height and the interstand tension of the rolling material, which is a controlled process model for outputting an interstand tension in due consideration of a looper height and a weight parameter, as an output of a looper height control system, so that the interstand tension of the rolling material can be controlled not only by a speed change rate command value given to the primary rolling machine 10 but also by a pressure command value given to the looper hydraulic actuator 5. Robust control setting means 22B sets variable values for constituting the controlled process, weight parameters, weight functions for designating the response speed and the robust stability of the tension control system, weight functions for designating the response speed and the robust stability of the looper height control system, respectively on the basis of rolling conditions and rolled state. Robust control gain calculating means 21 calculates the values set by the robust control setting means in accordance with predetermined control gain calculating equations, to obtain control gains used by the control calculating means 20. The obtained control gain is given to the control calculating means 20. Therefore, a robust control (for controlling the system in a manner that is always stable) can be executed according to continually varying rolling conditions and rolling material. Further, since the weight parameters are introduced, the tension fluctuations can be suppressed by the looper height, so that the tension control can be executed in cooperation with primary rolling machine 10.

Figure 5:
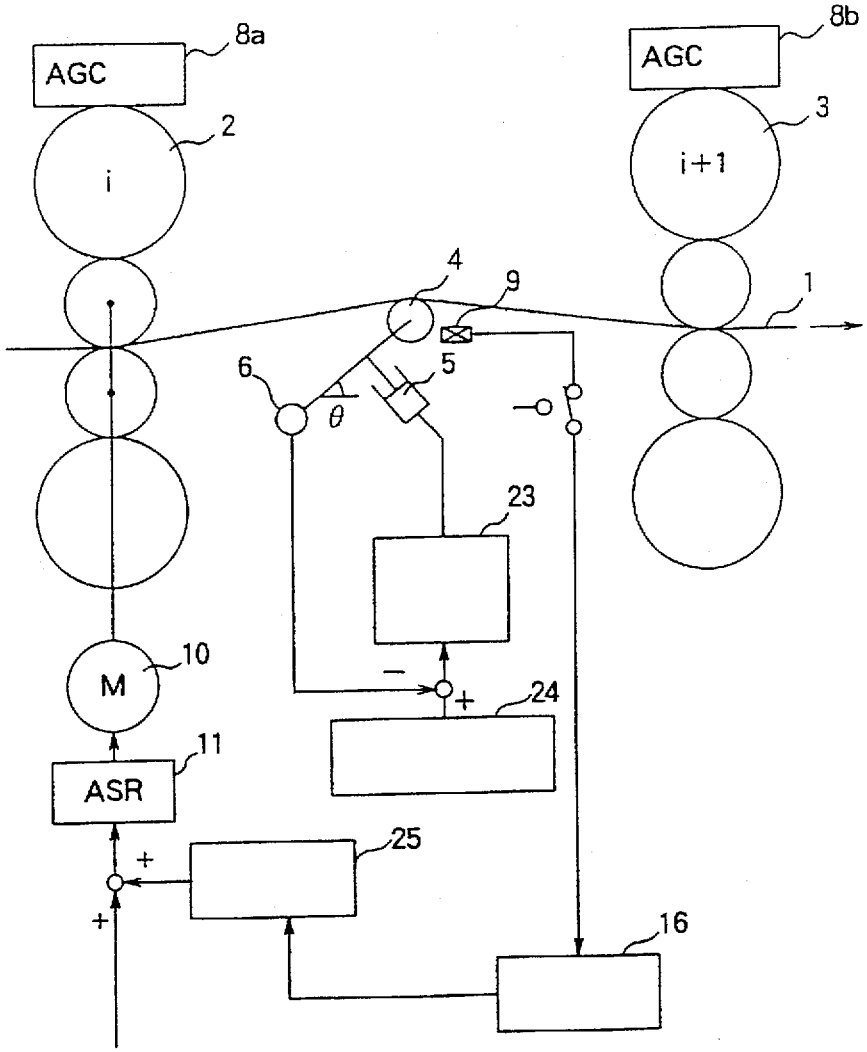
FIG. 5 is a schematic block diagram broadly depicting a fifth embodiment of the looper control system according to the present invention.

FIG. 5 is a schematic block diagram showing a fifth embodiment of the looper control system according to the present invention. The fifth embodiment of the looper control system according to the present invention can be summarized as follows: in the looper control system, looper height setting means 24 calculates a position command value of a hydraulic position controller and sets the calculated value to the hydraulic position controller 23 so that a looper height can be controlled at a target looper height value. Tension control means 25 calculates a speed change rate command value of a primary rolling machine 10 so that the interstand tension of the rolling material calculated by the tension calculating means 16 can be controlled at a target tension value, and sets an addition of the calculated value and the speed command value to the speed controller 11 of the primary rolling machine 10. Therefore, the looper height can be controlled at the target value, and further the rolling operation can be stabilized. In addition, the interstand tension can be controlled at the target value under excellent conditions.

In the looper control system as described above, the interstand tension can be detected by any one of means for calculating an interstand tension on the basis of a tension meter disposed on the looper and means for detecting hydraulic flow rate in a hydraulic actuator obtained by subtracting pressure components not related to tension from the inner pressure of the hydraulic actuator. Therefore, it is possible to select any interstand tension detecting means suitable to the control system.

The respective embodiments of the present invention will be described in further detail hereinbelow with reference to the attached drawings.

Figure 6:
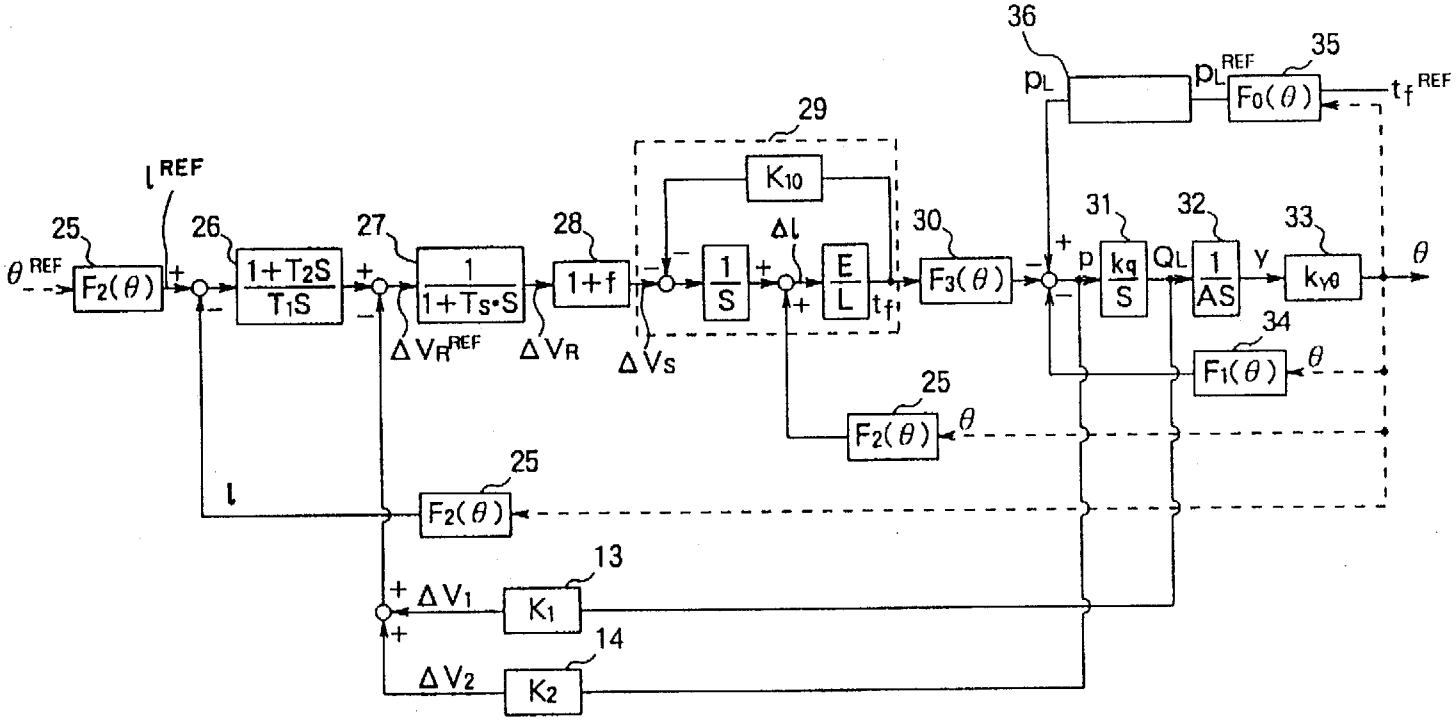
FIG. 6 is a detailed block diagram showing the construction of the first embodiment of the looper control system according to the present invention.

FIG. 6 is a detailed block diagram showing the control system shown in FIG. 1. In FIG. 6, blocks 27 to 34 denote a process to be controlled, which corresponds to the elements denoted by reference numerals 1 to 7 and 9 to 12. The block 27 is a primary rolling mill speed control system, in which a speed control system composed of the primary rolling mill (referred to hereafter as a "primary machine") and the primary machine speed controller 11 are combined as a single block. In block 27, the speed response of the primary machine is represented by use of a first order lag time constant $T_s$, which is a transfer function from a change rate $\Delta V_R^{REF}$ (of a roll peripheral reference speed $\Delta V_R^{REF}$) to a roll peripheral speed change rate $\Delta V_R$. The block 28 denotes an influence coefficient from the primary machine speed to the rolling material speed, where f denotes an advance ratio. The block 29 denotes a modeled tension generation process, in which a tension generation gain is represented by use of a Young's modulus E of the material and a distance L between the two stands and further which is represented by use of an integrator 1/S of the tension generation process and a tension feedback coefficient $K_{10}$.

The generated tension is transformed into a pressure applied to the looper hydraulic unit through the block 30 of a function $F_3(\theta)$. The pressure p applied to the hydraulic unit is integrated by the block 31 and further transformed into a variable of a flow rate $Q_L$. Further, the flow rate $Q_L$ is transformed into an actuator position y, and finally transformed into a looper angle θ through the block 33. The block 34 is a function $F_1(\theta)$ indicative of the change of the pressure due to weights of the material and the looper themselves. The block 25 is a function $F_2(\theta)$ used to transform the looper angle θ to an interstand material loop length.

The looper height is generally controlled in accordance with PI (proportional plus integral) control, as shown by the block 26.

To control the interstand tension, a pressure command value $p_L^{REF}$ for controlling the tension at the target tension value $t_f^{REF}$ is calculated by the function $F_0(\theta)$ of the block 35. The block 36 is a pressure control section of the hydraulic unit. In general, any one of the pressure control and the position control can be selected to control the hydraulic unit. In the first to fourth embodiments of the looper control system, the pressure control method is adopted for the hydraulic unit.

The above-mentioned $F_0(\theta)$, $F_1(\theta)$, $F_2(\theta)$ and $F_3(\theta)$ will be explained in further detail hereinbelow:

The function $F_0(\theta)$ is used to calculate the pressure command value $P_L^{REF}$, which can be expressed by equation (1) below:

$$F_0(\theta) = \frac{R_1 \sin\gamma}{A1_1}\left[t_f^{REF} A_S\{\sin(\theta+\beta)-(\theta-\alpha)\} + gW_S\cos\theta + \frac{gR_3}{R_1}W_L\cos\theta\right] \quad (1)$$

$$P_L^{REF} = F_0(\theta) \quad (2)$$

-continued $$\alpha = \tan^{-1}\frac{H_L}{L_1+L_2} \quad (3A)$$

$$\beta = \tan^{-1}\frac{H_L}{L-L_1-L_2} \quad (3B)$$

$$H_L = R_1 \sin\theta + R_2 - H_1$$

$$L_2 = R_1 \cos\theta$$

Figure 7:
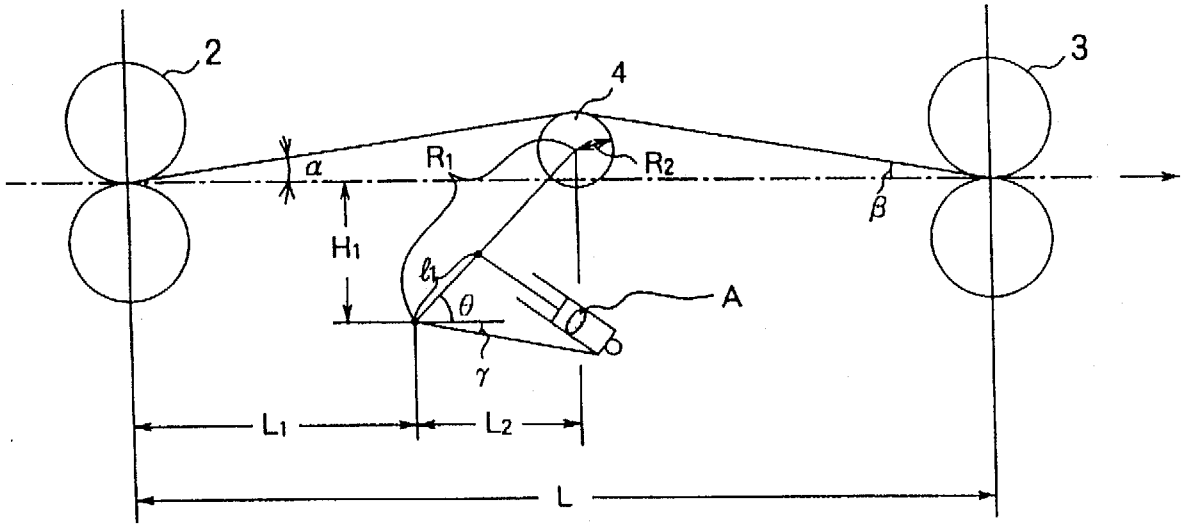
FIG. 7 is an illustration showing a geometrical relationship between the looper and the stands, for assistance in explaining the operation of the embodiment shown in FIG. 6.

The variables in the above equations (1), (2), (3A) and (3B) have the following meanings in correspondence to the geometrical relationship of the looper shown in FIG. 7 as follows:

g: Acceleration of gravity $R_1$: Distance between a rotational center of the looper and a center of a looper roll $R_2$: Radius of the looper roll $R_3$: Distance between the rotational center of the looper and a gravitational center of the looper roll $A_s$: Cross-sectional area of the rolled material (the product of a plate thickness and a plate width)

A: Cross-sectional area of the hydraulic actuator

α: Angle between the pass line and the rolling material

β: Angle between the pass line and the rolling material

γ: Angle between the horizontal line and a line connected between the pivotal center of the hydraulic actuator and the rotational center of the looper $W_s$: Interstand mass of the rolling material (obtained on the basis of the length, cross-sectional area, specific gravity of the rolling material)

$W_L$: Looper mass $L_1$: Distance between the looper pivotal center and the upstream stand $H_1$: Distance between the looper pivotal center and the pass line Here, when the looper angle θ and the tension command value $t_{fREF}$ can be set in accordance with the equations (1), (2), (3A) and (3B), the pressure command value $P_L^{REF}$ can be calculated.

Further, the function $F_1(\theta)$ can be expressed by the transfer function from the rolling material tension to the pressure as expressed by equation (4) as follows:

$$F_1(\theta) = \frac{\sin\gamma}{A1_1} g[R_1 W_S\cos\theta + R_3 W_L\cos\theta] \quad (4)$$

The differential equation of equation 2 is also shown as follows for later convenience:

$$F_1'(\theta) = \frac{dF_1(\theta)}{d\theta} = -\frac{\sin\gamma}{A1_1} g[R_1 W_S\sin\theta + R_3 W_L\sin\theta] \quad (5)$$

In general, the relationship between the looper angle (controlled variable) and the primary machine speed (manipulated variable) is non-linear. On the other hand, the relationship between the primary machine speed and the interstand rolling material loop rate l is linear. Therefore, the looper angle θ is transformed into the loop rate l, and the looper height control system is constructed by use of the loop rate. The non-linear function $F_2(\theta)$ for transforming the looper angle θ into the loop rate l can be expressed by the following equation (6):

$$F_2(\theta)=\frac{L_1+R_1\cos\theta}{\cos\alpha}-\frac{L-L_1-R_1\cos\theta}{\cos\beta}-L \tag{6}$$

The differential equation of equation 6 is also shown as follows for later convenience:

$$F'_2(\theta)=\frac{dF_2(\theta)}{d\theta}=R_1\{\sin(\theta+\beta)-\sin(\theta-\alpha)\} \tag{7}$$

The loop rate l is $$l=F_2(\theta) \tag{8}$$

where $L_1$: the distance between the rotational center of the looper and the i-th stand.

Further, the tension $t_f$ can be represented by a partial tension pressure $P_T$ applied to the looper hydraulic actuator. The block 20 represents the partial tension pressure $P_T$ linearly, and $F_3(\theta)$ can be expressed by the following equation (9):

$$F_3(\theta)=\frac{A_S R_1\sin\gamma}{Al_1}=\{\sin(\theta+\beta)-\sin(\theta-\alpha)\} \tag{9}$$

The block 13 related to the first embodiment of the looper control system detects the flow rate within the hydraulic actuator. The detected flow rate is multiplied by a gain $K_1$ to obtain the primary machine speed change rate $\Delta V_1$. On the other hand, the block 14 detects the flow rate within the hydraulic actuator. The detected flow rate is multiplied by a gain $K_2$ to obtain the primary machine speed change rate $\Delta V_2$. Here, however, the flow rate in the actuator is not usually detected, the flow rate within the hydraulic actuator can be substituted for the differential value of the actuator position or the integral value of the actuator pressure.

The effect obtained when $\Delta V_1$ to $\Delta V_2$ are fed back will be explained hereinbelow:

On the assumption that the tension control is now being executed ideally in the control system shown in FIG. 6, when the control path from $\Delta V_R^{REF}$ to θ is expressed by a transfer function by disregarding the tension control, the expressed transfer function includes the following transfer function G(S) of a secondary resonance system:

$$G(S)=\frac{\omega_n 2}{S^2+2\cdot\omega_n\cdot S+\omega_n 2}\cdot\frac{1}{S} \tag{10}$$

where $$\text{Resonance frequency}\ \omega_n=\sqrt{\frac{Ek_q}{L}(F_2(\theta)\cdot F_3(\theta))} \tag{11}$$

$$\text{Damping constant}\ \zeta=\frac{1}{2_n}\ \omega\left(\frac{K_{10}\cdot E}{L}\right) \tag{12}$$

In equation (11), it can be understood that if the parameters E, L, $k_q$, $F_2$, and $F_3$ on the right side of equation (11) can be changed, the resonance frequency can be changed. However, since these values are inherent to the looper control system (except that $F_2$ can be changed indirectly), it is impossible to directly change these parameters.

Figure 8:
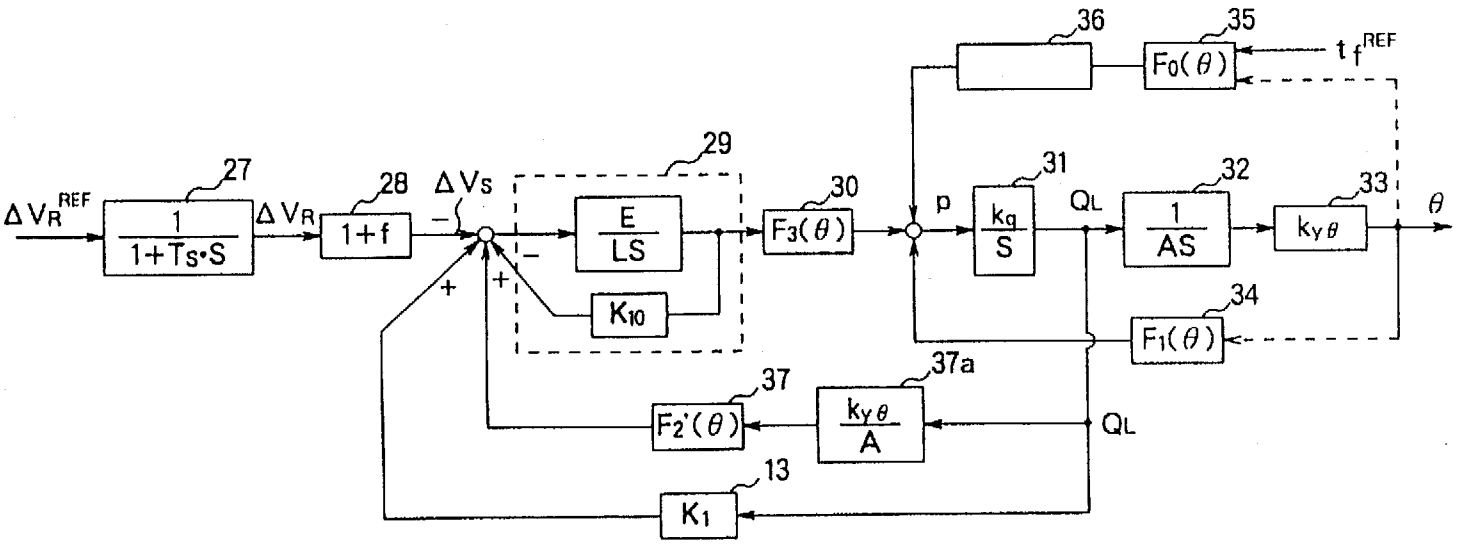
FIG. 8 is an illustration showing a block diagram, in which some parts are removed from that shown in FIG. 6, for assistance in explaining the operation of the embodiment shown in FIG. 6.

Here, FIG. 8 shows means for changing $F_2(\theta)$ on the right side of equation (11) equivalently. In FIG. 8, a block 37 shows the equation (7), and a block 37*a* shows a transform coefficient when the input signal is changed form the looper angle θ to the flow rate $Q_L$.

The gain $K_1$ of the block 13 shown in FIG. 6 is a constant control gain inserted in parallel to $F_2(\theta)$ of the block 37 having a value inherent to the looper control system. Therefore, it is possible to change $F_2(\theta)$ equivalently by inserting the constant control gain $K_1$.

When $K_1$ is inserted, the resonance frequency changes as follows:

$$\omega_n=\sqrt{\frac{Ek_q}{L}\left\{\left(F_2(\theta)+K_1\frac{A}{k_y\theta}\right)\cdot F_3(\theta)\right\}} \tag{13}$$

As described above, when the resonance frequency is required to be changed, it is effective to change $F_2(\theta)$ equivalently. However, since it is impossible to directly change the material speed $V_S$, the material speed $V_S$ is changed by changing the peripheral roll speed $V_R$. That is, in FIG. 6, $\Delta V_1$ is fed back as the primary machine speed change rate.

In this case, however, when a sensor for measuring the flow rate $Q_L$ in the hydraulic actuator is not mounted, the flow rate $Q_L$ can be substituted by integrating the pressure p or by differentiating the actuator position y.

In general, it is preferable that the resonance frequency $\omega_n$ is high, because the response speed of the looper height control system can be increased. However, when the resonance frequency $\omega_n$ is increased, since the damping constant ζ decreases, as understood by equation (12), the looper height control system easily vibrates. Therefore, when the resonance frequency $\omega_n$ is increased, it is necessary to adopt a method of increasing the damping constant ζ from the standpoint of the system stability. The practical method of constructing the damping constant changing means 14 shown in FIG. 6 will be explained hereinbelow.

As one method of increasing the damping constant, Japanese Published Examined (Kokoku) Patent Application No. (JA-B) 3-10406 discloses an "electrically operated looper control system". In this method, the rotational looper speed is differentiated, and the obtained differential looper speed is multiplied by a constant. According to the above-mentioned patent, it is possible to increase the damping constant ζ. In the case of the hydraulic looper, since the rotational speed of the electrically operated looper corresponds to the flow rate, the differential value thereof corresponds to the pressure. Therefore, $\Delta V_2$ obtained by multiplying the pressure p by the gain $K_2$ is fed back as the primary machine speed change rate.

The second embodiment of the looper control system will be described hereinbelow. In the first to fifth embodiments of the looper control system according to the present invention, since a common controlled process model is used, the controlled process model will be explained hereinbelow. Further, although the pressure of the hydraulic unit is controlled, here it is assumed that the pressure can be obtained in accordance with the pressure command value at a sufficiently high pressure response speed and thereby the response lag thereof can be disregarded.

The state equation of the process model of a controlled system can be expressed by the following equations (14) and (15):

$$\begin{pmatrix}\Delta\dot{t}_f\\ \Delta\dot{\theta}\\ \Delta\dot{Q}_L\\ \Delta\dot{V}_R\end{pmatrix}=\begin{pmatrix}\frac{-E\cdot K_{10}}{L} & 0 & \frac{E\cdot F_2'}{L} & \frac{-E(1+f)}{L}\\ 0 & 0 & \frac{K_y}{A} & 0\\ -F_3k_q & -F'_1k_q & 0 & 0\\ 0 & 0 & 0 & -\frac{1}{T_S}\end{pmatrix}=\begin{pmatrix}\Delta t_f\\ \Delta\theta\\ \Delta Q_L\\ \Delta V_R\end{pmatrix}+ \tag{14}$$

-continued $$\begin{pmatrix} 0 & 0 \\ 0 & 0 \\ 0 & k_q \\ \frac{1}{T_S} & 0 \end{pmatrix} \begin{pmatrix} \Delta V_R^{REF} \\ \Delta p_L^{REF} \end{pmatrix}$$

Here, the above first matrix on the right side is expressed as A, and the above second matrix on the right side is expressed as B.

Here, the upper suffix REF (superscript) represents the command of the respective symbols. Further, $F_1'=F_1'(\theta)$ is shown by equation (5), and $F_2'=F_2'(\theta)$ is shown by equation (6).

$$\begin{pmatrix} \Delta t_f \\ \Delta\theta \end{pmatrix} = \begin{pmatrix} 1 & 0 & 0 & 0 \\ 0 & 1 & 0 & 0 \end{pmatrix} \begin{pmatrix} \Delta t_f \\ \Delta\theta \\ \Delta Q_L \\ \Delta V_R \end{pmatrix} \tag{15}$$

Here, the above matrix on the right side is expressed as C. Here, Δ attached to the front of the respective symbols represents a micro-change of each symbol. Further, [.] attached to the upper portion of the respective symbols represents a differential value with respect to time. Therefore, the state equation can be represented by the following equation (16), for instance, on condition that t denotes time and T denotes a transposition;

$$\Delta t_f = d(\Delta t_f)/d_t \tag{16}$$

$$\left.\begin{aligned} \dot{x} &= Ax + Bu \\ y &= Cx \end{aligned}\right\}$$

State vector $x=[\Delta t_f \Delta\theta \Delta Q_L \Delta V_S]^T$

Output vector $y=[\Delta t_f \Delta\theta]^T$

Input vector $v=[\Delta V_R^{REF} \Delta p_L^{REF}]^T$

The dimensions of the respective matrices are that A is 4×4; B is 4×2; and C is 2×4, as shown in equations (14) and (15), respectively. Here, for brevity, the variables are replaced as follows:

$$\left.\begin{aligned} a_{11} &= -EK_{10}/L \\ a_{13} &= EF_2/L \\ a_{14} &= -E(1+F)/L \\ a_{23} &= K_T\theta/A \\ a_{31} &= -F_3k_q \\ a_{32} &= -F_1k_q \\ a_{44} &= -1/T_S \\ b_{32} &= k_q \end{aligned}\right\} \tag{17}$$

Therefore, the transfer function matrix from the input vector $u=[\Delta V_r^{REF} \Delta p_L^{REF}]^T$ to the output vector $y-[\Delta t_f \Delta\theta]^T$ can be expressed as follows:

$$\begin{pmatrix} \Delta t_f \\ \Delta\theta \end{pmatrix} = \begin{pmatrix} W_{11} & W_{12} \\ W_{21} & W_{22} \end{pmatrix} \begin{pmatrix} \Delta V_R^{REF} \\ \Delta p_L^{REF} \end{pmatrix} \tag{18}$$

Here, if $W_{11}=W_{11}N/W_{11}D$, $$w_{11}N = a_{14} \cdot a_{44} \cdot (a_{23} \cdot a_{32} - s^2) \tag{19}$$

-continued $$W_{11}D = a_{11} \cdot a_{23} \cdot a_{32} \cdot a_{44} + (a_{11} \cdot a_{23} \cdot a_{32} + a_{13} \cdot a_{31} \cdot a_{44} + a_{23} \cdot a_{32} \cdot a_{44})S + (a_{11} \cdot a_{44} \cdot -a_{13} \cdot a_{31} - a_{23} \cdot a_{32})S^2 - (a_{11} + a_{44})S^3 + S^4 \tag{20}$$

$$\text{If } W_{12} = W_{12}N/W_{12}D, \quad W_{12}N = a_{13} \cdot b_{32} \cdot S \tag{21}$$

$$W_{12}D = a_{11} \cdot a_{23} \cdot a_{32} - (a_{13} \cdot a_{31} + a_{23} \cdot a_{32})S - a_{11} \cdot S^2 + S^2 \tag{22}$$

$$\text{If } W_{21} = W_{21}N/W_{21}D, \quad W_{21}N = a_{14} \cdot a_{23} \cdot a_{31} \cdot a_{44} \tag{23}$$

$$W_{21}D = a_{11} \cdot a_{23} \cdot a_{32} \cdot a_{44} - (a_{11} \cdot a_{23} \cdot a_{32} - a_{13} \cdot a_{31} \cdot a_{44} - a_{23} \cdot a_{32} \cdot a_{44})S + (-a_{11} \cdot a_{44} + a_{13} \cdot a_{31} + a_{23} \cdot a_{23})S^2 + (a_{11} + a_{44})S^3 - S^4 \tag{24}$$

$$\text{If } W_{22} = W_{22}N/W_{22}D, \quad W_{22}N = -a_{23} \cdot b_{32} \cdot (a_{11} - S) \tag{25}$$

$$W_{22}D = a_{11} \cdot a_{23} \cdot a_{32} - (a_{13} \cdot a_{31} + a_{23} \cdot a_{32})S - a_{11} \cdot S^2 + S^3 \tag{26}$$

Figure 9:
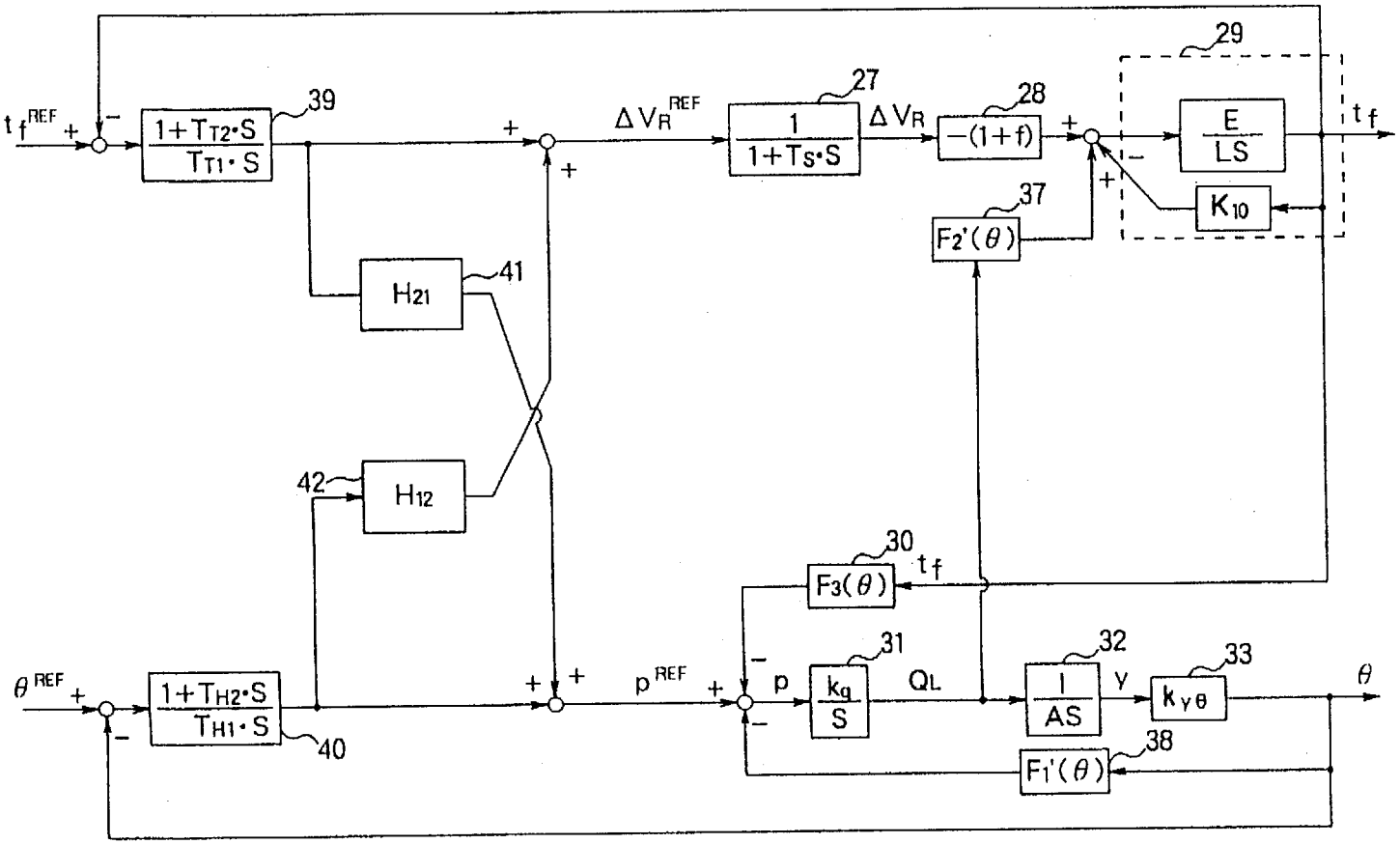
FIG. 9 is a detailed block diagram showing the construction of the second embodiment of the looper control system according to the present invention.

FIG. 9 is a block diagram showing the detailed construction of the second embodiment of the looper control system according to the present invention. In FIG. 9, a block 38 represents $F_1(\theta)$ of the block 34 shown in FIG. 8 in a linear form, which can be designated by $F_1'(\theta)$ of equation (5) obtained by differentiating $F_1(\theta)$ of equation (4).

The control calculating means 15 shown in FIG. 2 is constructed by the blocks 39, 40, 41 and 42 shown in FIG. 9. The contents of these blocks will be explained hereinbelow, respectively.

A tension controller 39 outputs the manipulated variable so that the detected tension value $t_f^{REF}$, and an angle controller 40 outputs the manipulated variable so that the detected angle value θ can approach the target angle value $\theta^{REF}$. The parameters of the tension controller or the angle controller can be decided as for a controller corresponding to a one-input one-output system, on the assumption that the two controllers are not perfectly interfering with each other by the following cross-controllers.

The cross controllers 41 and 42 can be designed so that the controlled variables are canceled by each other as follows:

$$\text{Cross controller 41: } H_{21} = -W_{12}/W_{11} \tag{27}$$

$$\text{Cross controller 42: } H_{12} = -W_{21}/W_{22} \tag{28}$$

By the above-mentioned two cross controllers, it is possible to eliminate the mutual interference existing in the controlled process, with the result that the response speed of the control system sao far restricted in the conventional PI (proportional plus integral) control can be improved.

Figure 10:
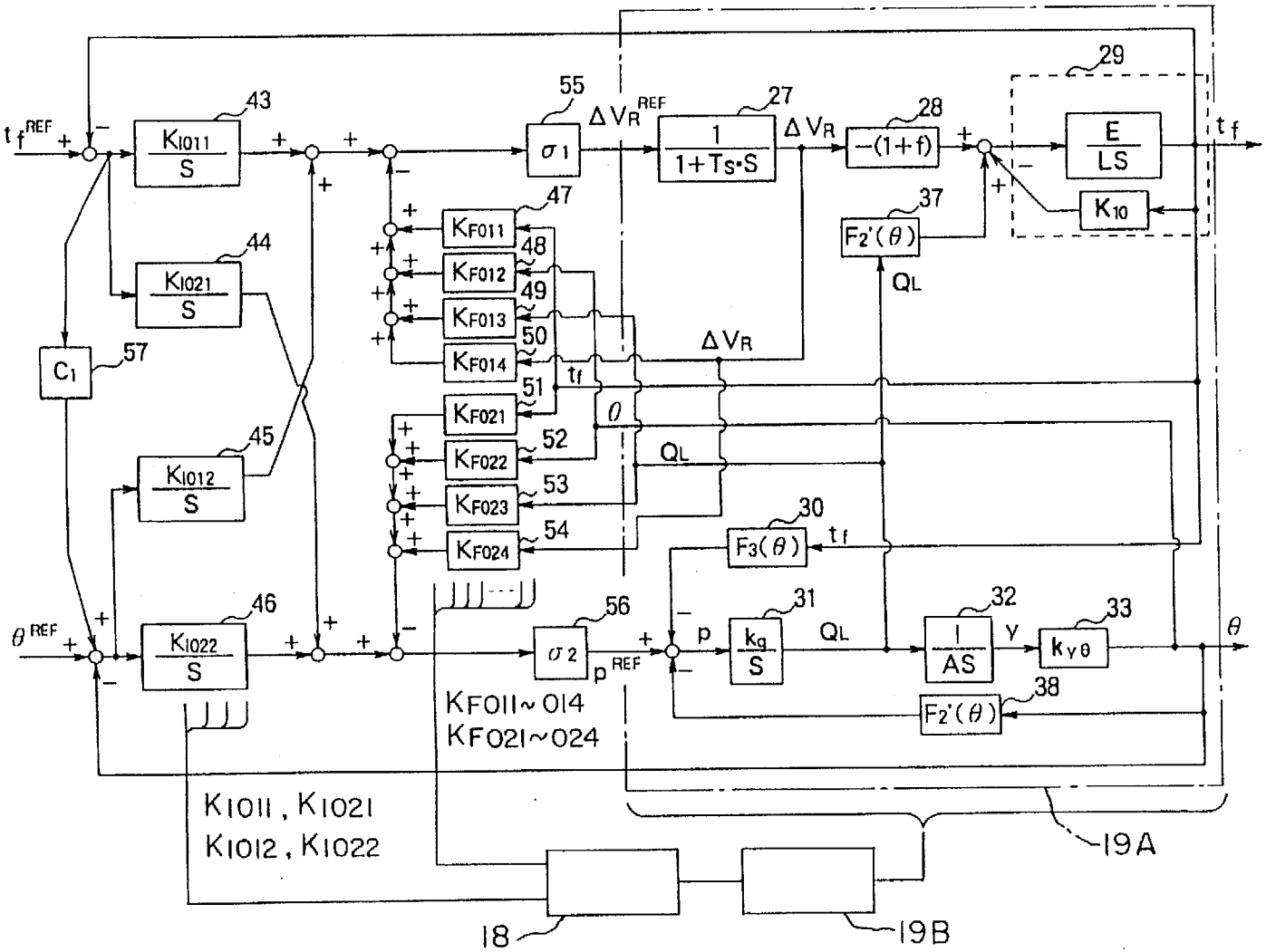
FIG. 10 is a detailed block diagram showing the construction of the third embodiment of the looper control system according to the present invention.

The third embodiment of the looper control system according to the present invention will be explained. FIG. 10 is a detailed block diagram showing the third embodiment of the control system, which corresponds to the control system shown in FIG. 3. Further, the blocks 43 to 57 shown in FIG. 10 correspond to the control calculating means 17 shown in FIG. 3.

In the process model for a controlled system expressed by equations (14) and (15), the looper height control system controls both the looper height and the rolling material tension. For this purpose, a detected tension value having a weight parameter $C_1$ (shown in block 57 in FIG. 10) is added to the detected looper height value, as a feedback rate applied to two integrators 45 and 46. Further, a tension command value having a weight parameter $C_1$ is added to the looper height command value.

In order to control both the lopper height and the interstand tension by the looper height control system, equation (15) can be modified as follows:

$$\begin{pmatrix} \Delta t_f \\ \Delta y_2 \end{pmatrix} = \begin{pmatrix} 1 & 0 & 0 & 0 \\ C_1 & 1 & 0 & 0 \end{pmatrix} \begin{pmatrix} \Delta t_f \\ \Delta\theta \\ \Delta Q_L \\ \Delta V_R \end{pmatrix} \tag{29}$$

Here, the control variable $\Delta\theta$ in equation (15) is changed to $\Delta y_2$ of the following equation (30) in accordance with the above equation (29):

$$\Delta y_2 = C_1 \Delta t_f + \Delta\theta \tag{30}$$

Here, when the weight $C_1$ is increased, since the relative importance of rolling material tension $t_f$ increases, although the rolling material tension can be controlled well, the looper height $\theta$ fluctuates largely. Further, when the weight $C_1$ is decreased, since the relative importance of rolling material tension $t_f$ decreases, the looper height $\theta$ can be controlled at the constant value stably. Further, when the weight $C_1$ is zero, the process model becomes the same as with the case of the conventional process model, as expressed by equation (15).

Here, the control gain deciding method from the block 43 to the block 56 shown in FIG. 10 is as follows. Basically, the control gain is decided in accordance with an ILQ (inverse linear quadratic) method. The ILQ method is a method of solving the LQ (linear quadratic) control problem from the standpoint of the inverted problem, which is well-known in the art, as shown for example in a document "Generalization of ILQ Optimum Servo System Design Method" by Takao FUJII, Taku SHIMOMURA, Proceedings of System Control Information Society, Vol. 1, No. 6, 1988.

By the use of the controlled process model using equations (14) and (15), the control gains from the block 43 to the block 56 can be expressed by the following equations on the assumption that $\Delta t_f$ and $\Delta y_2$ do not interfere with each other:

43: $K_{F011} = 4\omega_{TC}^2 \cdot T_S (C_1 \cdot E \cdot F_2' \cdot A + K_{1\theta} \cdot L) / (K_{1\theta}(1+f) \cdot E)$ (31)

44: $K_{F021} = -4C_1 \cdot \omega_{TC}^2 \cdot A / (K_{1\theta} \cdot k_q)$ (32)

45: $K_{F012} = 4A \cdot F_2^1 \cdot \omega_{HC}^2 \cdot T_s / K_{1\theta}(1+f)$ (33)

46: $K_{F022} = 4A \cdot \omega_{HC}^2 / (K_{1\theta} \cdot k_q)$ (34)

47: $K_{F011} = T_S \cdot \{4C_1 \cdot E \cdot F_2' \cdot A \cdot (\omega_{HC} - \omega_{TC}) + E \cdot K_{10} \cdot K_{1\theta} - 4L \cdot K_{1\theta} \cdot \omega_{TC}\} / (K_{1\theta}(1+f) \cdot E)$ (35)

48: $K_{F012} = 4A \cdot F_2 \cdot T_S \cdot \omega_{HC} / (K_{1\theta}(1+f)$ (36)

49: $K_{F013} = 0$ (37)

50: $K_{F014} = T_S$ (38)

51: $K_{F021} = 4C_1 \cdot A \cdot (\omega_{HC} - \omega_{TC}) / (K_{1\theta} \cdot k_q)$ (39)

52: $K_{F022} = 4A \cdot \omega_{HC} / (K_{1\theta} \cdot k_q)$ (40)

53: $K_{F023} = 1/k_q$ (41)

54: $K_{F024} = 0$ (42)

where $\omega_{TC}$: Cutoff frequency of the designated response of tension control system (rad/s)

$\omega_{HC}$: Cutoff frequency of the designated response of looper height control system (rad/s)

As these values, any desired values can be designated. Further, $K_{FOij}$ represents a feedback gain from the j-th element x(j) of the state vector x to the i-th element u(i) of the input vector u, and $K_{IOik}$ represents an integral gain from the deviation (if k–1, $\Delta t_{REF} - \Delta t_f$ and if k=2, $\Delta\theta_{REF} + C_1 \cdot \Delta t_f$) to the i-th element u(i) of the input vector u. Further, $K_{F015}$ and $K_{F025}$ are both zero, so that the description thereof is omitted herein.

The control gain from equation (21) to equation (42) is constructed by the numerical representations by the variable of the process mode for a controlled system and the designated response variables.

The adjustment coefficient $\sigma_1$ is selected so that the response of the tension control system becomes a desired response, and the adjustment coefficient $\sigma_2$ is selected so that the response of the looper height control system becomes a desired response. In general, when the $\sigma_1$ and $\sigma_2$ are set to a large value, respectively, a high speed response speed can be obtained, respectively. In practice, however, since the manipulated variables (the primary speed command value and the pressure command value) are increased, it is not practical to set an excessively large value as these coefficients.

The various variables and parameters of equations (31) to (42) are set from the multi-variable control setting means 19B to the multi-variable control gain calculating means 18 in FIG. 3. In more detail, the variables $T_S$, E, $F_2'$, A, $K_{10}$, L, f, $K_{1\theta}$ and $k_q$ are given as variables for representing the controlled process model. The variables $\omega_{TC}$ and $\omega_{HC}$ are given as variables for designating the responses of the tension and the looper height. The variable $C_1$ is given as a weight parameter. Further, the adjustment coefficients $\sigma_1$ and $\sigma_2$ (shown in FIG. 10) are given as variables for adjusting the responses of the tension and the looper height. The multi-gain control calculating means 18 substitutes these set variables for equations (31) to (42) to calculate the control gains of the blocks 43 to 54, and further transmits these control gains to the control calculating means 17 together with the set values $\sigma_1$ and $\sigma_2$.

As described above, it is possible to appropriately control the looper height the interstand tension which exert a serious influence upon the product quality. Further, it is possible to easily adjust the control gains on the basis of the controlled process parameters which vary according to the various rolling conditions. Further, it is also possible to adaptively control the controlled gains by changing the parameters in sequence according to the rolling conditions.

Figure 11:
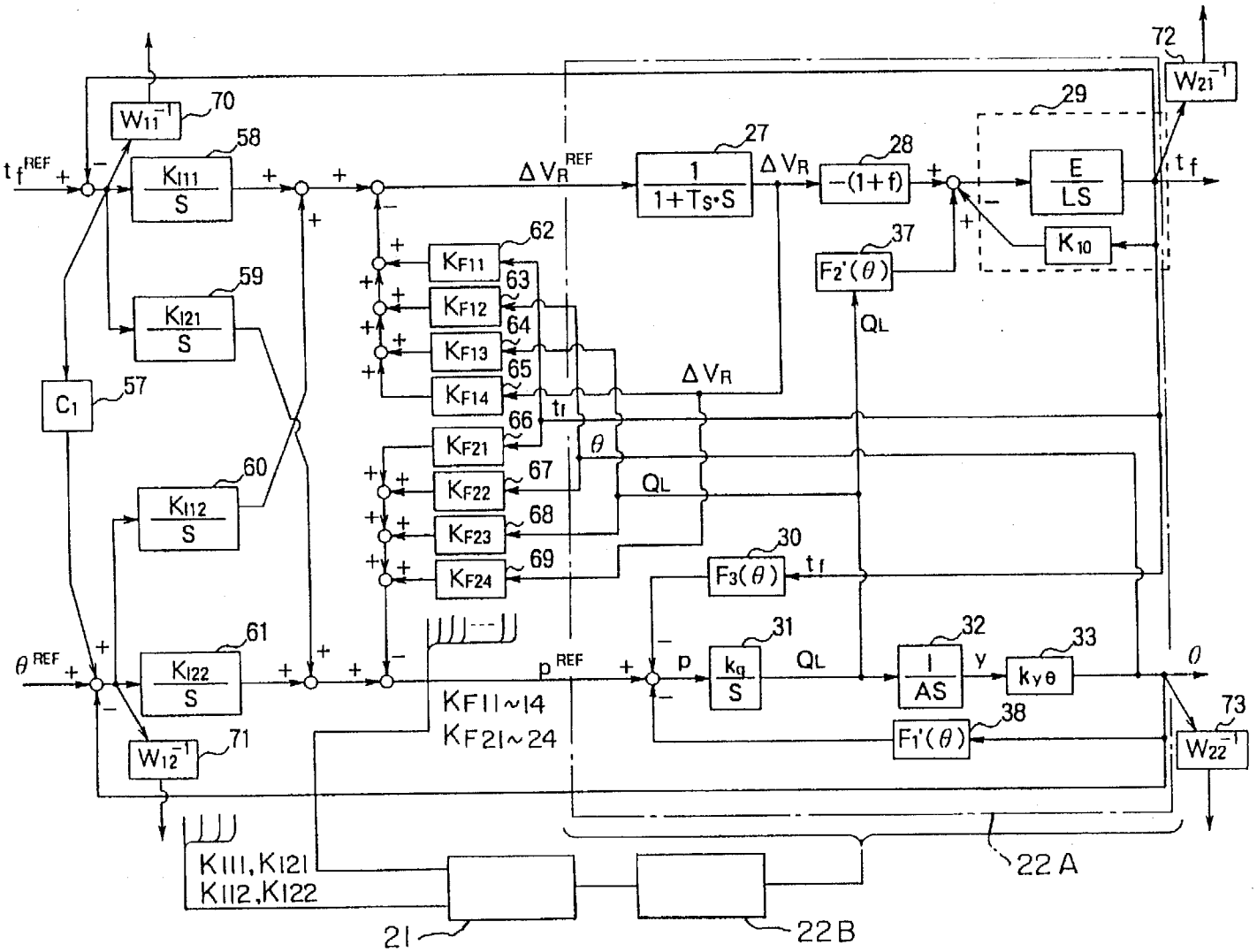
FIG. 11 is a detailed block diagram showing the construction of the fourth embodiment of the looper control system according to the present invention.

The fourth embodiment of the looper control system according to the present invention will be described hereinbelow. FIG. 11 is a detailed block diagram showing the fourth embodiment of the control system, which corresponds to the control system shown in FIG. 4. Further, the blocks 57 and 69 shown in FIG. 11 correspond to the control calculating means 20 shown in FIG. 4.

The process model for a controlled system is the same as expressed by the aforementioned equations (14) to (29), which has been explained with reference to FIG. 3.

The blocks from 58 to 69 shown in FIG. 11 are decided by the controller as follows: Basically, these blocks are determined in accordance with the H-∞ (robust) control. Here, the transfer function from a target value to a control deviation (a difference between a target value and a controlled variable) is referred to as a sensitive function. Further, the transfer function from a target value to a controlled variable is referred to as a sensitive function. In the H-∞ control, a problem is formularized so that the responses of both the sensitive function and the complementary sensitive function can be set to desired values, respectively, and further a controller is obtained so that the above-mentioned conditions can be satisfied.

Figure 12:
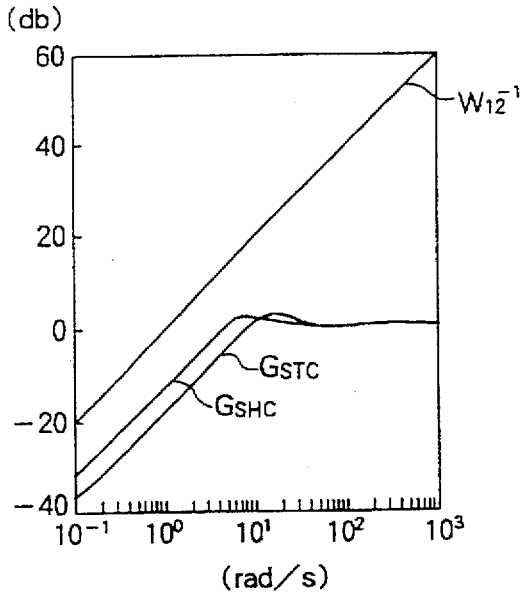
FIG. 12 is a graphical representation showing the relationship between the frequency and the gain, for assistance in explaining the design method of the control system shown in FIG. 11.
Figure 13:
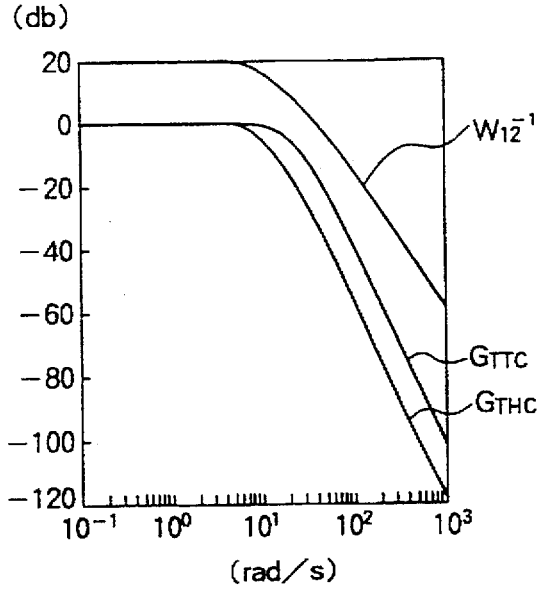
FIG. 13 is a graphical representation showing the relationship between the frequency and the gain, for assistance in explaining the design method of the control system shown in FIG. 11.

FIGS. 12 and 13 show the method of deciding the sensitive function and the complementary sensitive function, by way of example, respectively. FIG. 12 represents the sensitive function $C_{STC}$ of the tension control system, the sensitive function $G_{SHC}$ of the looper height control system, and a reciprocal $W_{12}^{-1}$ of the weight function $W_{12}$ corresponding to the sensitive function of the looper height control system. Further, FIG. 13 represents the complementary sensitive function $G_{TCC}$ of the tension control system, the complementary sensitive function $G_{THC}$ of the looper height control system, and a reciprocal $W_{22}$ corresponding to the complementary sensitive function of the looper height control system. When the controller is designed, the sensitive function can be decided by setting the weight functions $W_{11}$ and $W_{12}$, and further the complementary sensitive function can be decided by setting the weight functions $W_{21}$ and $W_{22}$.

As shown in FIGS. 12 and 13, it is general to set the respective weight functions in such a way that the sensitive function can decrease the gain in a low-frequency band and the complementary sensitive function can increase the gain in a high-frequency band, respectively. The reason is as follows:

First, when the sensitive function and the complementary function are added to each other, the result is necessarily 1. In other words, $G_{STC}+G_{TCC}=1$, and $G_{SHC}+G_{THC}=1$. Under these restrictions, it is impossible to decrease both the sensitive function and the complementary sensitive function simultaneously in the whole frequency band, so that it is necessary to decrease the sensitivity function in a frequency band and to decrease the complementary sensitivity function in another frequency band.

Further, in general, the sensitivity function is mainly related to the quick response characteristics of the control system, and the complementary sensitivity function is mainly related to the robust stability of the control system. Therefore, it is apparent that the gain of the sensitivity function is decreased in the whole frequency band to obtain a high quick response characteristic and that the gain of the complementary sensitivity function is decreased in the whole frequency band to obtain a high robust stability. However, it is impossible to satisfy the two functions simultaneously in the whole frequency band under the above-mentioned restrictions. Accordingly, the gain of the sensitivity function is small in the law frequency band, because the controlled variable is required to follow the target value only in a low frequency range. Further, the gain of the complementary sensitive function is small in the high frequency range to improve the robust stability by setting the gain from the target value to the controlled variable small in the high frequency range from the standpoint of noise suppression characteristics.

In practice, the sensitivity function $G_{STC}$ is an index for representing the quick response characteristics of the tension control; the sensitivity function $G_{SHC}$ is an index for representing the quick response characteristics of the looper height control; the complementary sensitivity function $G_{TTC}$ is an index for representing the robust stability of the tension control; and the complementary sensitivity function $G_{THC}$ is an index for representing the robust stability of the looper height control.

As described above, the sensitivity function and the complementary sensitivity function are a response in a closed-loop obtained after the controller has been calculated by setting weight functions. The sensitivity functions $G_{STC}$ and the complementary sensitivity function $G_{TTC}$ related to the tension control are decided by the weight functions $W_{11}$ and $W_{21}$. The sensitivity functions $G_{SHC}$ and the complementary sensitivity function $G_{THC}$ related to the looper height control are decided by the weight functions $W_{12}$ and $W_{22}$, respectively.

The index of the quick response characteristics exists at a frequency in the vicinity of a point at which the sensitivity function $G_{STC}$ crosses the 0-db line. In the case of FIG. 12, the response of the tension control is about 7 rad/s at the intersection angular frequency.

The index of the robust stability is a gain difference between the complementary sensitivity function and the reciprocal of the weight function. In FIG. 13, the index of the robust stability of the looper height control system is a difference between $W_{22}^{-1}$ and $G_{THC}$ of about 20 db. This implies that the stability can be maintained even if an error between the actual process and the model is about 20 db (=ten times).

The various variables, the parameters, and the functions are set from the robust control setting means 22B to the robust control gain calculating means 21 in FIG. 4. In more detail, the variables $T_S$, E, $F_1'$, $F_2'$, $F_3$, A, $K_{10}$, L, f, $K_{1\theta}$ and $k_q$ are given as variables for representing the controlled process model. The variable $C_1$ is given as a weight parameter. Further, the functions $W_{11}$ and $W_{22}$ are given as weight functions for designating the responses and the robust stability of the looper height control system. The robust control gain calculating means 21 calculates the respective control gains from block 58 to block 69 on the basis of these set values, and further transmits these control gains to the control calculating means 20 as numerical values.

The fact that the robust stability is designed large implies that the control system can be maintained stable even if the controlled process changes in a wide range, with the result that it is possible to cope with the rolling conditions varying in a wide range on the basis of only a single controller gain. In other words, it is unnecessary to control a plurality of controller gains according to the rolling conditions.

Figure 14:
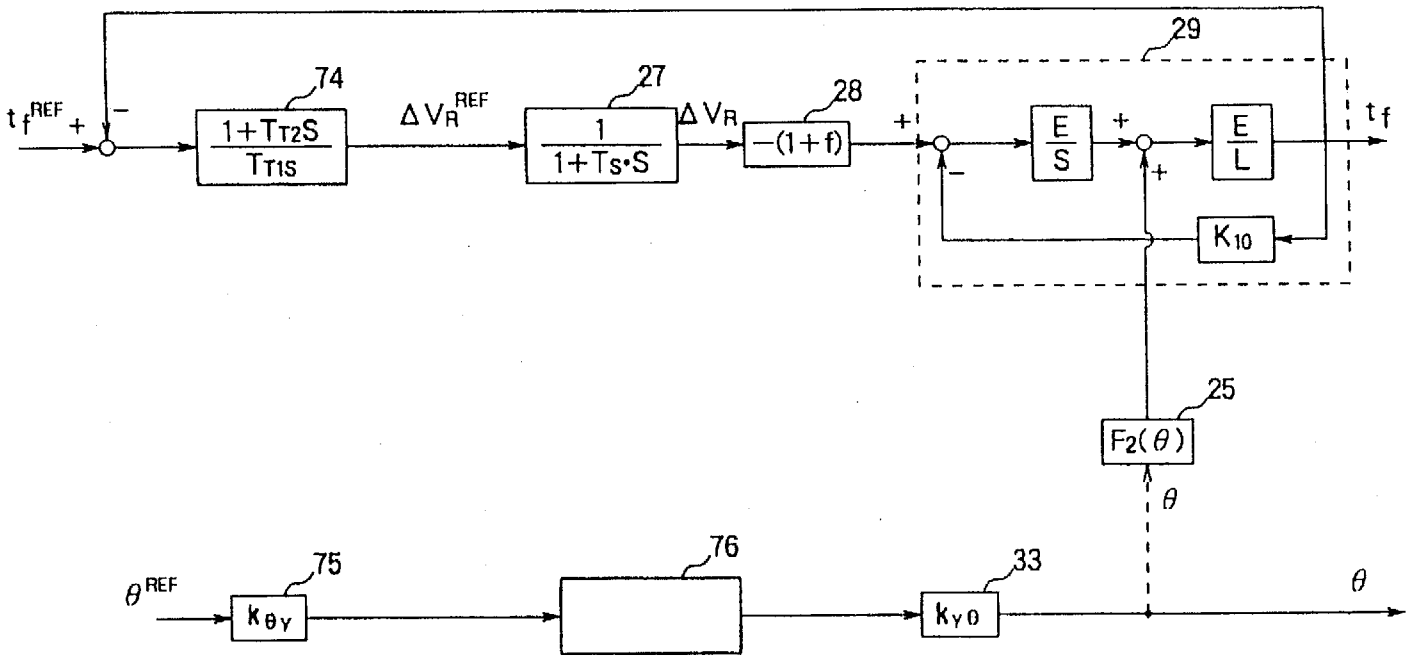
FIG. 14 is a detailed block diagram showing the construction of the fifth embodiment of the looper control system according to the present invention.

The fifth embodiment of the looper control system according to the present invention will be explained. FIG. 14 is a detailed block diagram showing the fifth embodiment of the control system, which corresponds to the control system shown in FIG. 5.

In the first to fifth embodiments of the looper control system according to the present invention, the control method of the looper hydraulic unit is one of pressure control. In the case of the fifth embodiment, the control method of the looper hydraulic unit is one of position control. That is, the looper height control means 24 shown in FIG. 5 transforms the target angular value into a position command value of the hydraulic actuator ($K_{\theta y}$ in block 75), and then applied to a hydraulic position controller 76.

In general, the hydraulic position control is high in the response speed. Therefore, it is possible to neglect the disturbance from the tension system in FIG. 14.

On the other hand, the tension control system calculates the primary machine speed change rate command $\Delta V_R^{REF}$ so that the actual tension value matches the target tension value through the tension controller 74. The tension controller 74 is of PI control type. Without being limited only thereto, the tension controller 74 can be constructed on the basis of PID control.

As described above, since the looper height can be controlled at a constant value without being subjected to the disturbance from the tension system, it is possible to attain non-interference between the tension control system and the looper height control system. In addition, since the looper height will not fluctuate, it is possible to attain non-interference between the looper height control system and the tension control system.

In the second to fifth embodiments of the looper control system according to the present invention, an actual tension value is used. The actual tension value can be calculated by use of a tension meter mounted on the looper. The actual tension value also can be calculated on the basis of the pressure detected by the looper hydraulic unit 7. The latter method will be explained hereinbelow.

The detected pressure $p_L$ includes various elements such as pressure $p_{LT}$ applied by the tension, pressure $p_{LL}$ applied by the looper own weight, pressure $p_{LS}$ applied by the material weight, pressure $p_{LLOS}$ required to compensate for the loss rate (caused by the static friction and dynamic friction) when the looper is driven, and pressure $p_{LA}$ required when the looper is decelerated or accelerated as follows:

$$p_L=p_{LT}+p_{LL}+p_{LS}+p_{LLOS}+p_{LA} \tag{43}$$

Here, the pressure $p_{LL}$ applied by the looper weight and the pressure $p_{LLOS}$ required to compensate for the loss rate generated when the looper is driven can be obtained by measuring the pressure by setting the looper angle as parameters on condition that no rolled material exists; that is, by obtaining $p_{LL}$ and $p_{LLOS}$ at the respective looper angles as a function.

On the other hand, the pressure $p_{LS}$ due to the material weight can be obtained by the following equation (44)

$$p_{LS}=\sin\gamma\cdot R_1\cdot g\cdot W_S\cos\theta/(A\cdot l_1) \tag{44}$$

where $W_S$ denotes the material weight.

Further, the pressure $p_{LA}$ due to the looper deceleration and acceleration can be calculated by obtaining the acceleration rate of the hydraulic actuator and in accordance with the following equation:

$$p_{LA}=\frac{M}{A}\cdot\frac{d^2y}{dt^2} \tag{45}$$

Here, y denotes the hydraulic actuator position; M denotes an addition of the looper own weight and the material own weight; and A denotes the cross-sectional area of the actuator.

In general, the acceleration is calculated by use of a digital computer as follows:

$$\frac{dy}{dt}=\frac{1}{T_S}\{y((n+1)T_S)-y(nT_S)\}=Z(nT_S) \tag{46}$$

$$\frac{d^2y}{dt^2}=\frac{1}{T_S}\{z((n+1)T_S)-z(nT_S)\} \tag{47}$$

where $T_S$ denotes the tension calculation period; and $y(iT_S)$ denotes the detected hydraulic actuator position.

On the other hand, it is of course possible to mount a speed meter on the hydraulic actuator to obtain the derivative of the obtained speed with respect to time as an acceleration, or to mount an acceleration meter to use the output thereof.

Further, the pressure $p_{LT}$ due to tension can be obtained on the basis of the equation (43) as follows:

$$p_{LT}=p_L-(p_{LL}+p_{LS}+p_{LLOS}+p_{LA}) \tag{48}$$

On the other hand, the relationship between the pressure and the tension is given by the equation (9), so that the tension $t_f$ can be calculated by the following equation:

$$t_f=p_{LT}/F_3(\theta) \tag{49}$$

As described above, it is possible to calculate the tension applied to the rolling material by detecting the pressure and the actuator position detected by the hydraulic unit.

The practical embodiments have been described above, by taking the case of a heavy rolling mill. Without being limited only thereto, the present invention can be applied to a rolling mill in another mode.

In the first embodiment of the looper control system according to the present invention, when the looper height and the tension in hot rolling are controlled in accordance with the conventional PI control, since the resonance frequency of the control system can be changed to a high frequency band, it is possible to improve the response speed of the looper height control system. Further, since the damping constant can be increased, the control system will not vibrate, so that a stable control can be attained.

In the second embodiment of the looper control system according to the present invention, when the looper height and the tension in hot rolling are controlled, since mutual interference between the tension and the looper height existing in the controlled process can be eliminated, it is possible to improve the response characteristics of the control system (which has been so far restricted in the conventional PI control). Further, since the magnitude of the damping constant is not required to be taken into account, it is possible to attain a stable control.

Further, in the third embodiment of the looper control system according to the present invention, when the looper height and the tension in hot rolling are controlled, since the controller gain can be expressed by the process variables and the variables representative of the designated response, it is possible to enable an optimum looper tension control under consideration of the rolling material state and the operating conditions, thus contributing to a stable rolling operation. Further, according to the present invention, since numerical tables (which require a large memory capacity) are not required to be stored (being different from the conventional method), it is possible to save the labor required to maintain and manage the tables. In addition, since the looper height can be used to control the interstand tension of the rolling material, it is possible to realize an excellent controllability of the rolling material tension, thus contributing to a stable rolling operation.

Further, in the fourth embodiment of the looper control system according to the present invention, when the looper height and the tension in hot rolling are controlled, since the robust stability can be set large, even if the parameters of the controlled process change significantly, it is possible to maintain the control system in a stable status. Therefore, the control system according to the present invention can cope with the rolling conditions varying in a wide range on the basis of only a single controller gain, without requiring controller gains of many sorts (sorted as tables including various different numerical values) according to the various rolling conditions. As a result, it is possible to execute more optimum control, as compared with the conventional control restricted by tables. In addition, since the looper height is used to control the rolling material tension, an excellent control performance can be realized to control the rolling material tension, thus contributing to a stable rolling operation.

Further, in the fifth embodiment to the looper control system according to the present invention, when the looper height and the tension in hot rolling are controlled, since the tension control system and the looper height control system do not interfere with each other, it is possible to attain a stable rolling operation.

Further, in the respective embodiments of the looper control system according to the present invention, when the looper height and the tension in hot rolling are controlled, since the tension can be calculated on the basis of the detected value of the tension meter or by use of the pressure component not related to the tension from the inner pressure of the hydraulic actuator, it is possible to select any actuator suitable for the control system construction.

Additional advantages and modifications will occur to those skilled in the art the invention in the broader aspects is, therefore, not limited to the specific details and representative apparatus shown and described above. Departures may be made for such details without departing from the scope of this invention, which is defined by the claims below and their equivalents.

What is claimed is:

1. A control system for a tandem rolling mill, comprising:

a looper control means for controlling a looper, the looper being provided between two rolling stands in the tandem rolling mill and applying a tension to a rolled material extending between the two rolling stands, said looper control means being hydraulically driven;

a tension control means for controlling the tension of the rolled material between the rolling stands;

a height control means for controlling a height of the looper;

said height control means and tension control means being configured to minimize an interference between control of the looper height and control of the rolled material tension; and calculating means for calculating a speed change rate command value of a primary rolling machine, and for calculating a pressure command value of a looper hydraulic actuator so that the rolled material tension and the looper height are controlled at a target tension value and target height, respectively, based on a detected looper height and a predetermined control gain, the calculated pressure command value being sent to the looper hydraulic actuator, the calculated speed change rate command value being added to a predetermined speed command value to obtain a first speed command value, the first speed command value being set in a primary machine speed controller, the primary machine speed controller comprising:

a hydraulic actuator for actuating the rolling mill;

resonance frequency changing means for detecting a hydraulic fluid flow rate of the hydraulic actuation and multiplying the detected value by a gain to obtain a second speed change rate command value of the primary rolling machine; and damping constant changing means for detecting pressure in the hydraulic actuator and multiplying the detected value by another gain, to obtain a third speed change rate command value of the primary rolling machine;

wherein the second and third speed change rate command values are added to the first speed command value to obtain a fourth speed command value, the fourth speed command value being set in the primary machine speed controller.

2. A control system for a tandem rolling mill, comprising:

a looper control means for controlling a looper, the looper being provided between two rolling stands in the tandem rolling mill and applying a tension to a rolled material extending between the two rolling stands, said looper control means being hydraulically driven;

a tension control means for controlling the tension of the rolled material between the rolling stands:

a height control means for controlling a height of the looper;

said height control means and tension control means being configured to minimize an interference between control of the looper height and control of the rolled material tension; and calculating means for calculating a speed change rate command value of a primary rolling machine, and for calculating a pressure command value of a looper hydraulic actuator so that the rolled material tension and the looper height are controlled at a target tension value and target height, respectively, based on a detected looper height and a predetermined control gain, the calculated pressure command value being sent to the looper hydraulic actuator, the calculated speed change rate command value being added to a predetermined speed command value to obtain a first speed command value, the first speed command value being set in a primary machine speed controller, the primary machine speed controller comprising:

a hydraulic actuator for actuating the rolling mill;

a first cross-controller for cancelling a first interference transfer function between the first speed command value of the primary rolling machine and the looper height, and a second cross-controller for cancelling a second interference transfer function between the pressure command value of the looper hydraulic actuator and the rolled material tension, both by modeling a multi-variable system having a mutual interference between the looper height and the rolled material tension as a transfer function; and a tension controller for controlling a detected tension value at a target tension value, and a height controller for controlling a detected looper height at a target looper height value, both such that the mutual interference can be eliminated by said first and second cross-controllers;

wherein first output of said tension controller is input to said first cross-controller, an output of said first cross-controller is added to a first output of said height controller at the pressure command value of the looper hydraulic actuator, a second output of said height controller is input to said second cross-controller, and an output of said second cross-controller is added to a second output of said tension controller as a second speed change rate command value of the primary rolling machine.

3. A control system for a tandem rolling mill, comprising:

a looper control means for controlling a looper, the looper being provided between two rolling stands in the tandem rolling mill and applying a tension to a rolled material extending between the two rolling stands, said looper control means being hydraulically driven;

a tension control means for controlling the tension of the rolled material between the rolling stands;

a height control means for controlling a height of the looper;

said height control means and tension control means being configured to minimize an interference between control of the looper height and control of the rolled material tension; and calculating means for calculating a speed change rate command value of a primary rolling machine, and for calculating a pressure command value for a looper hydraulic actuator so that the rolled material tension and the looper height are controlled at a target tension value and a target height, respectively, based on a detected looper height value and a predetermined control gain, the calculated pressure command value being sent to the looper hydraulic actuator, the calculated speed rate change command value of the primary rolling machine being added to a predetermined speed command value to obtain a first speed command value, the first speed command value being set in a primary machine speed controller, the primary machine speed controller comprising:

a hydraulic actuator for actuating the rolling mill;

a controlled process model obtained by modeling a multi-variable system having mutual interference between the looper height and the rolled material tension, the rolled material tension including a weight parameter, the rolled material tension being controlled both by the first speed command value set in the primary rolling machine and the pressure command value sent to the looper hydraulic actuator;

multi-variable control setting means for setting a first set of variables representative of the controlled process model, a second set of variables for designating response speeds of the rolled material tension and the looper height, and a third set of variables for adjusting the response speed of the rolled material tension and the looper height and the weight parameter, respectively; and multi-variable control gain calculating means for substituting the variables obtained by said multi-variable control setting means for predetermined control gain equations, to obtain the control gain used by the calculating means as numerical values.

4. A control system for a tandem rolling mill, comprising:

a looper control means for controlling a looper, the looper being provided between two rolling stands in the tandem rolling mill and applying a tension to a rolled material extending between the two rolling stands, said looper control means being hydraulically driven;

a tension control means for controlling the tension of the rolled material between the rolling stands;

a height control means for controlling a height of the looper;

said height control means and tension control means being configured to minimize an interference between control of the looper height and control of the rolled material tension; and calculating means for calculating a speed change rate command value of a primary rolling machine, and for calculating a pressure command value for a looper hydraulic actuator so that the rolled material tension and the looper height are controlled at a target tension value and a target height, respectively, based on a detected looper height value and a predetermined control gain, the calculated pressure command value being sent to the looper hydraulic actuator, the calculated speed rate change command value of the primary rolling machine being added to a predetermined speed command value to obtain a first speed command value, the first speed command value being set in a primary machine speed controller, the primary machine speed controller comprising:

a hydraulic actuator for actuating the rolling mill;

a controlled process model obtained by modeling a multi-variable system having mutual interference between the looper height and the rolled material tension, the rolled material tension including a weight parameter, the rolled material tension being controlled both by the first speed command value set in the primary rolling machine and the pressure command value sent to the looper hydraulic actuator;

robust control setting means for setting variable values for the controlled process, including the weight parameter, weight functions for designating response speed and robust slanting of the tension control means, and weight functions for designating response speed and robust stability of the height control means, on the basis of rolling conditions and rolled state of the rolled material; and robust control gain calculating means for calculating the values set by said robust control setting means in accordance with predetermined control gain calculating equations, to obtain the control gain used by said calculating means.

5. A control system for a tandem rolling mill, comprising;

a looper control means for controlling a looper, the looper being provided between two rolling stands in the tandem rolling mill and applying a tension to a rolled material extending between the two rolling stands, said looper control means being hydraulically driven;

a tension control means for controlling the tension of the rolled material between the rolling stands; and a height control means for controlling a height of the looper;

said tension control means and said height control means being configured to minimize an interference between control of the looper height and control of the rolled material tension;

calculating means for calculating a speed change rate command value of a primary rolling machine, and for calculating a pressure command value of a looper hydraulic actuator so that the rolled material tension and the looper height are controlled at a target tension value and target height, respectively, based on a detected looper height and a predetermined control gain, the calculated pressure command value being sent to the looper hydraulic actuator, the calculated speed change rate command value being added to a predetermined speed command value to obtain a first speed command value, the first speed command value being set in a primary machine speed controller, the primary machine speed controller comprising;

a hydraulic actuator for actuating the rolling mill;

resonance frequency changing means for detecting a hydraulic fluid flow rate of the hydraulic actuator and multiplying the detected value by a gain to obtain a second speed change rate command value of the primary rolling machine; and damping constant changing means for detecting pressure in the hydraulic actuator and multiplying the detected value by another gain, to obtain a third speed change rate command value of the primary rolling machine;

wherein the second and third speed change rate command values are added to the first speed command value to obtain a fourth speed command value, the fourth speed command value being set in the primary machine speed controller, and wherein the rolled material tension is detected by one of means for calculating the rolled material tension on the basis of a tension meter mounted on the looper, and means for detecting hydraulic flow rate in the hydraulic actuator and further for calculating a pressure value due to the tension of the rolled material, in such a way that a looper weight, an interstand weight of the rolled material, a drive loss, and a pressure caused by looper acceleration or deceleration at looper angle or hydraulic actuator position are all subtracted from a detected inner pressure value of the hydraulic pressure, to obtain a rolled material tension value on the basis of the calculated pressure value.

6. A looper control system of claim 5, wherein the calculating means includes:

looper height sending means for calculating a position command value and for setting the calculated position command value to a hydraulic position controller.

7. A method of controlling a tandem rolling mill, comprising:

controlling a looper height at a target looper height value by calculating a position command value, and setting the position command value into a hydraulic position controller;

controlling tension of a rolling material at a target tension value by calculating a speed charge rate command value of a primary rolling machine, and adding the calculated speed change rate command value to a predetermined speed command value to obtain a first speed command value, and setting the first speed command value into a speed controller of the primary rolling machine; and minimizing an interference between looper height control and rolling material tension control.

8. A control system for a tandem rolling mill, comprising:

a looper control means for controlling a looper, the looper being provided between two rolling stands in the tandem rolling mill and applying a tension to a rolled material extending between the two rolling stands, said looper control means being hydraulically driven;

a tension control means for controlling the tension of the rolled material between the rolling stands;

a height control means for controlling a height of the looper;

said tension control means and said height control means being configured to minimize an interference between control of the looper height and control of the rolled material tension; and calculating means for calculating a speed change rate command value of a primary rolling machine, and for calculating a pressure command value of a looper hydraulic actuator so that the rolled material tension and the looper height are controlled at a target tension value and a target height, respectively, based on a detected looper height and a predetermined control gain, the calculated pressure command value being sent to the looper hydraulic actuator, the calculated speed change rate command value being added to a predetermined speed command value to obtain a first speed command value, the first speed command value being set in a primary machine speed controller, the primary machine speed controller comprising:

a hydraulic actuator for actuating the rolling mill;

a first cross-controller for canceling a first interference transfer function between the first speed command value of the primary rolling machine and the looper height, and a second cross-controller for canceling a second interference transfer function between the pressure command value of the looper hydraulic actuator and the rolled material tension, both by modeling a multi-variable system having a mutual interference between the looper height and the rolled material tension as a transfer function; and a tension controller for controlling a detected tension value at a target tension value, and a height controller for controlling a detected looper height at a target looper height value, both such that the mutual interference can be eliminated by said first and second cross-controllers;

wherein a first output of said tension controller is input to said first cross-controller, an output of said first cross-controller is added to a first output of said height controller at the pressure command value of the looper hydraulic actuator, a second output of said height controller is input to said second cross-controller, and an output of said second cross-controller is added to a second output of said tension controller as a second speed change rate command value of the primary rolling machine, and wherein the rolled material tension is detected by one of means for calculating the rolled material tension on the basis of a tension meter mounted on the looper, and means for detecting hydraulic flow rate in the hydraulic actuator and further for calculating a pressure value due to the tension of the rolled material, in such a way that a looper weight, an interstand weight of the rolled material, a drive loss, and a pressure caused by looper acceleration or deceleration at looper angle or hydraulic actuator position are all subtracted from a detected inner pressure value of the hydraulic pressure, to obtain a rolled material tension value on the basis of the calculated pressure value.

9. A looper control system of claim 8, wherein the calculating means includes:

looper height setting means for calculating a position command value and for sending the calculated position command value to a hydraulic position controller.

10. A control system for a tandem rolling mill, comprising:

a looper control means for controlling a looper, the looper being provided between two rolling stands in the tandem rolling mill and applying a tension to a rolled material extending between the two rolling stands, said looper control means being hydraulically driven;

a tension control means for controlling the tension of the rolled material between the rolling stands;

a height control means for controlling a height of the looper;

said height control means and tension control means being configured to minimize an interference between control of the looper height and control of the rolled material tension; and calculating means for calculating a speed change rate command value of a primary rolling machine, and for calculating a pressure command value for a looper hydraulic actuator so that the rolled material tension and the looper height are controlled at a target tension value and a target height, respectively, based on a detected looper height value and a predetermined control gain, the calculated pressure command value being set in the looper hydraulic actuator, the calculated speed rate change command value of the primary rolling machine being added to a predetermined speed command value to obtain a first speed command value, the first speed command value being set in a primary machine speed controller, the primary machine speed controller comprising:

a hydraulic actuator for activating the rolling mill;

a controlled process model obtained by modeling a multi-variable system having mutual interference between the looper height and the rolled material tension, the rolled material tension including a weight parameter, the rolled material tension being controlled both by the first speed command value set in the primary rolling machine and the pressure command value sent to the looper hydraulic actuator;

multi-variable control setting means for setting a first set of variables representative of the controlled process model, a second set of variables for designating response speeds of the rolled material tension and the looper height, and a third set of variables for adjusting the response speeds of the rolled material tension and the looper height and the weight parameter, respectively; and multi-variable control gain calculating means for substituting the variables obtained by said multi-variable control setting means for predetermined control gain equations, to obtain the control gain used by the calculating means as numerical values, wherein the rolled material tension is detected by one of means for calculating the rolled material tension on the basis of a tension meter mounted on the looper, and means for detecting hydraulic flow rate in the hydraulic actuator and further for calculating a pressure value due to the tension of the rolled material, in such a way that a looper weight, an interstand weight of the rolled material, a drive loss, and a pressure caused by looper acceleration or deceleration at looper angle or hydraulic actuator position are all subtracted from a detected inner pressure value of the hydraulic pressure, to obtain a rolled material tension value on the basis of the calculated pressure value.

11. A looper control system of claim 10, wherein the calculating means includes:

looper height setting means for calculating a position command value and for sending the calculated position command value to a hydraulic position controller.

12. A control system for a tandem rolling mill, comprising:

a looper control means for controlling a looper, the looper being provided between two rolling stands in the tandem rolling mill and applying a tension to a rolled material extending between the two rolling stands, said looper control means being hydraulically driven;

a tension control means for controlling the tension of the rolled material between the rolling stands; and a height control means for controlling a height of the looper;

said height control means and tension control means being configured to minimize an interference between control of the looper height and control of the rolled material tension;

calculating means for calculating a speed change rate command value of a primary rolling machine, and for calculating a pressure command value for a looper hydraulic actuator so that the rolled material tension and the looper height are controlled at a target tension value and a target height, respectively, based on a detected looper height value and a predetermined control gain, the calculated pressure command value being sent to the looper hydraulic actuator, the calculated speed rate change command value of the primary rolling machine being added to a predetermined speed command value to obtain a first speed command value, the first speed command value being set in a primary machine speed controller, the primary machine speed controller comprising:

a hydraulic actuator for actuating the rolling mill;

a controlled process model obtained by modeling a multi-variable system having mutual interference between the looper height and the rolled material tension, the rolled material tension including a weight parameter, the rolled material tension being controlled both by the first speed command value set in the primary rolling machine and the pressure command value sent to the looper hydraulic actuator;

robust control setting means for setting variable values for the controlled process, including the weight parameter, weight functions for designating response speed and robust slanting of the tension control means, and weight functions for designating response speed and robust stability of the height control means, on the basis of rolling conditions and rolled state of the rolled material; and robust control gain calculating means for calculating the values set by said robust control setting means in accordance with predetermined control gain calculating equations, to obtain the control gain used by said calculating means, wherein the rolled material tension is detected by one of means for calculating the rolled material tension on the basis of a tension meter mounted on the looper, and means for detecting hydraulic flow rate in the hydraulic actuator and further for calculating a pressure value due to the tension of the rolled material, in such a way that a looper weight, an interstand weight of the rolled material, a drive loss, and a pressure caused by looper acceleration or deceleration at looper angle or hydraulic actuator position are all subtracted from a detected inner pressure value of the hydraulic pressure, to obtain a rolled material tension value on the basis of the calculated pressure value.

13. A looper control system of claim 12, wherein the calculating means includes:

looper height setting means for calculating a position command value and for applying the calculated position command value to a hydraulic position controller.

* * * * *